US005485066A

United States Patent [19]

Zeigler

[11] Patent Number: 5,485,066

[45] Date of Patent: Jan. 16, 1996

[54] VARIABLE SPEED CENTRIFUGAL DRIVE CONTROL FOR SUGAR REFINING MACHINES AND THE LIKE

[75] Inventor: Dwayne Zeigler, Savannah, Ga.

[73] Assignee: Savannah Foods and Industries, Savannah, Ga.

[21] Appl. No.: 231,221

[22] Filed: Apr. 19, 1994

Related U.S. Application Data

[63] Continuation-in-part of Ser. No. 228,499, Apr. 15, 1994, abandoned.

[51] Int. Cl.[6] ..... H02P 5/00

[52] U.S. Cl. ..... 318/375; 318/6; 7/34

[58] Field of Search ..... 318/6, 7, 34–89, 318/369∝376, 778, 759; 222/1, 37, 63, 70, 643; 141/1; 127/15, 45, 19, 17, 19 UX, 56; 233/24; 494/4, 29; 425/9, 8, 145, 148; 34/8, 43, 56, 314, 65; 210/781; 241/5, 23

[56] References Cited

U.S. PATENT DOCUMENTS

| | | | |
|---|---|---|---|
| 2,427,101 | 9/1947 | Kochli . | |
| 2,752,044 | 6/1956 | Olcott . | |
| 2,759,372 | 8/1956 | Hertrich . | |
| 3,504,794 | 4/1970 | Tholl et al. . | |
| 3,906,315 | 9/1975 | Gotisar | 318/369 |
| 4,118,248 | 10/1978 | Lalcher | 127/19 |
| 4,223,829 | 9/1980 | Bange | 233/24 |
| 4,443,266 | 4/1984 | Schaper et al. . | |
| 4,482,853 | 11/1984 | Bhausar | 318/778 |
| 4,519,039 | 5/1985 | Surana et al. | 318/7 |
| 4,520,450 | 5/1985 | Snedden et al. | 318/7 |
| 4,532,597 | 7/1985 | Satiuddin et al. | 318/6 |
| 4,582,097 | 4/1986 | Izzi et al. | 141/1 |
| 4,848,673 | 7/1989 | Masuda et al. | 241/5 |
| 4,895,733 | 1/1990 | Imanidis et al. | 427/8 |
| 4,947,089 | 8/1990 | Abel | 318/34 |
| 5,044,092 | 9/1991 | Journet et al. | 34/8 |
| 5,087,864 | 2/1992 | Abel | 318/34 |
| 5,115,575 | 5/1992 | Journet et al. | 34/8 |
| 5,132,142 | 7/1992 | Jones et al. | 427/196 |
| 5,254,241 | 10/1993 | Bange et al. . | |
| 5,346,377 | 9/1994 | Bogue et al. | 425/9 |

FOREIGN PATENT DOCUMENTS 1350173 11/1987 U.S.S.R. .

*Primary Examiner*—Paul Ip
*Attorney, Agent, or Firm*—Cushman Darby & Cushman

[57] ABSTRACT

A drive control system for a centrifugal used in, for example, a sugar refining operation, optimizes the deceleration and plow-out phases of its operation based on the torque characteristics of its particular drive motor. This is achieved by providing a centrifugal having a pulse-width modulated (PWM) frequency-modulated drive controlled by a programmable logic controller (PLC) running a ladder logic program. The ladder logic program implements a regenerative braking loop which complements the dynamic braking characteristic curve of the drive motor, thereby obtaining an optimal amount of braking torque for the motor over a wide range of motor revolutions or frequencies. Preferably, the system also implements a dynamic plow-out control for the motor when in plow-out mode to enable the centrifugal to be plowed-out in a minimal amount of time.

18 Claims, 8 Drawing Sheets

VARIABLE SPEED CENTRIFUGAL DRIVE CONTROL FOR SUGAR REFINING MACHINES AND THE LIKE

This application is a continuation-in-part of Ser. No. 08/228,499, filed Apr. 15, 1994 in the name of the same inventor, now abandoned.

A portion of the disclosure of this patent document contains material which is subject to copyright protection. The copyright owner has no objection to the facsimile reproduction by anyone of the patent document or the patent disclosure, as it appears in Patent and Trademark Office file or records, but otherwise reserves all copyright rights whatsoever.

BACKGROUND OF THE INVENTION

1. Field of the Invention

The present invention relates to motor control systems, and more specifically, to a motor control system for centrifugals used in sugar refining machines and the like which implement graduated motor speed control to provide superior processing performance.

2. Description of the Related Art

Centrifugals used in refining sugar and similar substances are required to separate particulate sugar crystals from the syrup fraction of the massecuite, magma, or mother liquor that serves as the raw material in the refining process. When they are used in this way, they generally are classified as affination centrifugals. Also, they are used to spin moisture from the crystallized sugar during the cleaning process. When used in this way, they are called white sugar centrifugals.

The type of centrifugal used in these applications generally is the filter or basket centrifugal. FIG. 1 shows a typical centrifugal of this type. The centrifugal has a drive motor assembly 2 composed of a main drive motor 4 and a discharge drive motor 6 which alternately drive a perforated basket 8 disposed in a housing or curb 10. The basket 8 is usually about four feet high and three feet in diameter and can hold about 830 lb of raw sugar.

When used to separate impurities from the sugar product, the massecuite is loaded into the basket 8 and the main drive motor 4 spins the basket 8 to cause impurities in the massecuite to separate from the sugar due to centrifugal force. The screen of the basket 8 has apertures sufficiently small to retain sugar crystals included in the mixture, but the impurities pass through the perforations in the basket 8 and are drained off at the bottom of the curb 10. The sugar crystals accumulate on the screen and are held there by centrifugal force.

After the mixture has been separated, the basket 8 is spun down through a combination of regenerative motor braking and brake 12, and some sugar crystals adhere to the screen. These must be removed by a plow device 14 such as a knife or scraper that transits the screen surface of the basket 8 at a slow rotational speed when driven in reverse by the discharge motor 6. Once the sugar crystals have been removed from the sides of the basket 8 by the plow 14, a bell valve 16 in the basket 8 is raised or lowered (in the design shown in FIG. 1, it is lowered) to permit the sugar product to pass therethrough and be collected for further processing.

One stage of the additional processing involves the drying of a sugar slurry. At this point, it is necessary to remove moisture from the slurry by centrifugal spinning. This process involves a similar use of the centrifugal in which the slurry is introduced into the centrifugal basket 8 and excess moisture is spun out using the main drive motor 4. Then, the plow 14 is used to plow out the cake of dried sugar crystals formed during the spinning process while the basket 8 is driven by the discharge motor 6.

Prior art systems have used two-speed induction motors for main drive motor 4 to implement the above-described operations. Idealized speed and torque curves for a centrifugal cycle using such a motor are shown by traces 21 and 22 in FIG. 2, respectively, and trace 23 in FIG. 3 shows an actual cycle graph for a two-speed induction drive or current source modulated (CSM) centrifugal drive. The primary figure of merit in these systems is the cycle time, which is the amount of time required for the centrifugal to fully complete one sequential cycle of loading 26, accelerating 28, spinning 30, decelerating 32 and plowing out 34.

In the CSM drive arrangement, the main drive motor 4 is accelerated in its low speed mode until it reaches a desired loading speed (as shown in the Figure, about 250 rpm). The basket 8 is loaded, and the motor 4 is accelerated in high speed mode to spin the massecuite at about 1200 rpm to remove its impurities. Then, the centrifugal is decelerated, reversed, and plowed out as described above.

Operation of the CSM type drive has proven to be problematic for reasons of, for example, poor speed regulation capabilities, loss of kinetic energy due to high-slip operation and the brake 12, high maintenance requirements, and inability to use such motors in hazardous environments.

To partially overcome some of the above problems, prior art systems also have utilized pulse width modulated (PWM) drives for main drive 6, where the speed of the motor 6 is controlled by pulse width modulation. Trace 24 in FIG. 4 shows a typical cycle for a PWM centrifugal.

While these centrifugal systems function adequately, they have several disadvantages. For example, the amount of sugar that can be produced by a batch-type centrifugal such as those described above is necessarily limited by its cycle time.

Since the centrifugal runs in essentially a continuous operation, a cycle time decrease of a few seconds can result in a substantial increase in the efficiency (and consequently, productivity) of the machine. For example, a ten second decrease in a 150 second cycle time can result in an increase of 700,000 pounds of sugar per day over several centrifugals.

Within the cycle time, the loading and spinning time are generally constant for any centrifugal. While the accelerating, decelerating and plowing out phases are variable, they are limited at the lower end by the physical integrity of the centrifugal drive mechanism and by the quality of the finished product.

SUMMARY OF THE INVENTION

While the cycle time of prior art centrifugals has generally been viewed as being limited in part by their braking and plow-out times, the inventor has discovered that by implementing variable, non-linear curves for the deceleration and plow-out phases of the cycle, the cycle time itself can be significantly reduced. Further, the inventor has discovered that this technique provides a significant reduction in power consumption from both the faster cycle time and as a result of the synergistic advantages provided by this technique.

Therefore, it is an object of this invention to provide a drive control system for a centrifugal that has a reduced cycle time as compared to conventional drive systems.

It is a further object of this invention to provide a centrifugal system that has the ability to optimize the deceleration of the system based on a given drive motor's characteristics.

It is still another object of the present invention to provide a drive control system for a centrifugal that implements a dynamic braking function that tracks the dynamic braking curve of its drive motor.

It is a further object of the present invention to provide a drive control system for a centrifugal that transitions from spin to plow-out in a minimum amount of time.

It is yet another object of the present invention to provide a drive control system for a centrifugal that plows out finished product in a minimum amount of time.

It also is an object of the present invention to provide a centrifugal that consumes less power than do conventional systems.

The above objects are achieved by providing a drive control system for a centrifugal that optimizes the deceleration and plow-out phases of its operation based on the torque characteristics of its particular drive motor. This is achieved by providing a centrifugal having a PWM frequency-modulated drive controlled by a programmable logic controller (PLC) running a ladder logic program. The ladder logic program implements a regenerative braking loop which complements the dynamic braking characteristic curve of the drive motor, thereby obtaining an optimal amount of braking torque for the motor over a wide range of motor rpms. Preferably, the system also implements a dynamic plow-out control for the motor when in plow-out mode to enable the centrifugal to be plowed-out in a minimal amount of time.

BRIEF DESCRIPTION OF THE DRAWINGS

These and other objects and advantages of this invention will become apparent and more readily appreciated from the following description of the presently preferred exemplary embodiments, taken in conjunction with the accompanying drawings, of which.

DETAILED DESCRIPTION OF THE PRESENTLY PREFERRED EXEMPLARY EMBODIMENTS

Figure 5:
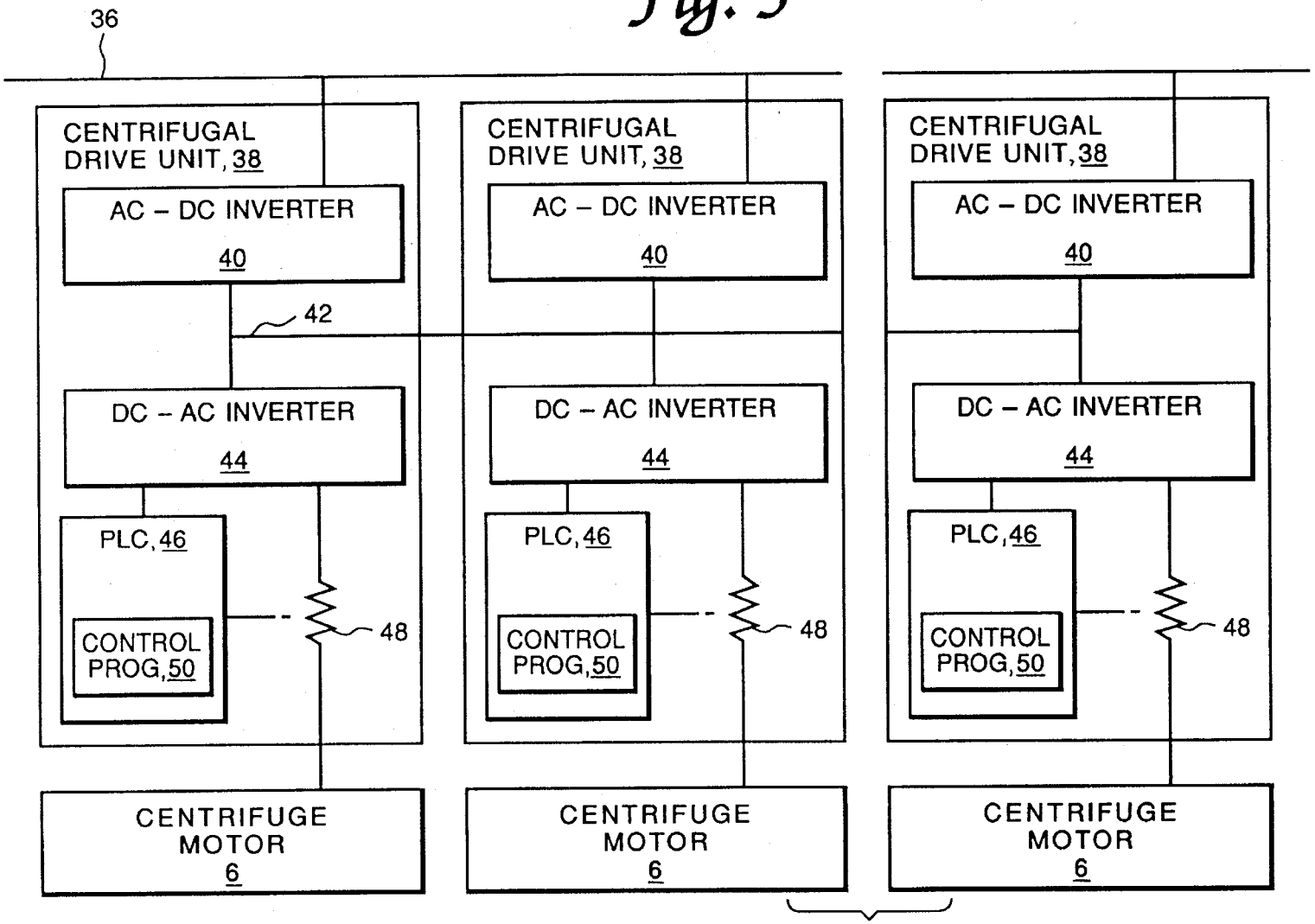
FIG. 5 is a block diagram of a preferred embodiment of the present invention.
Figure 6:
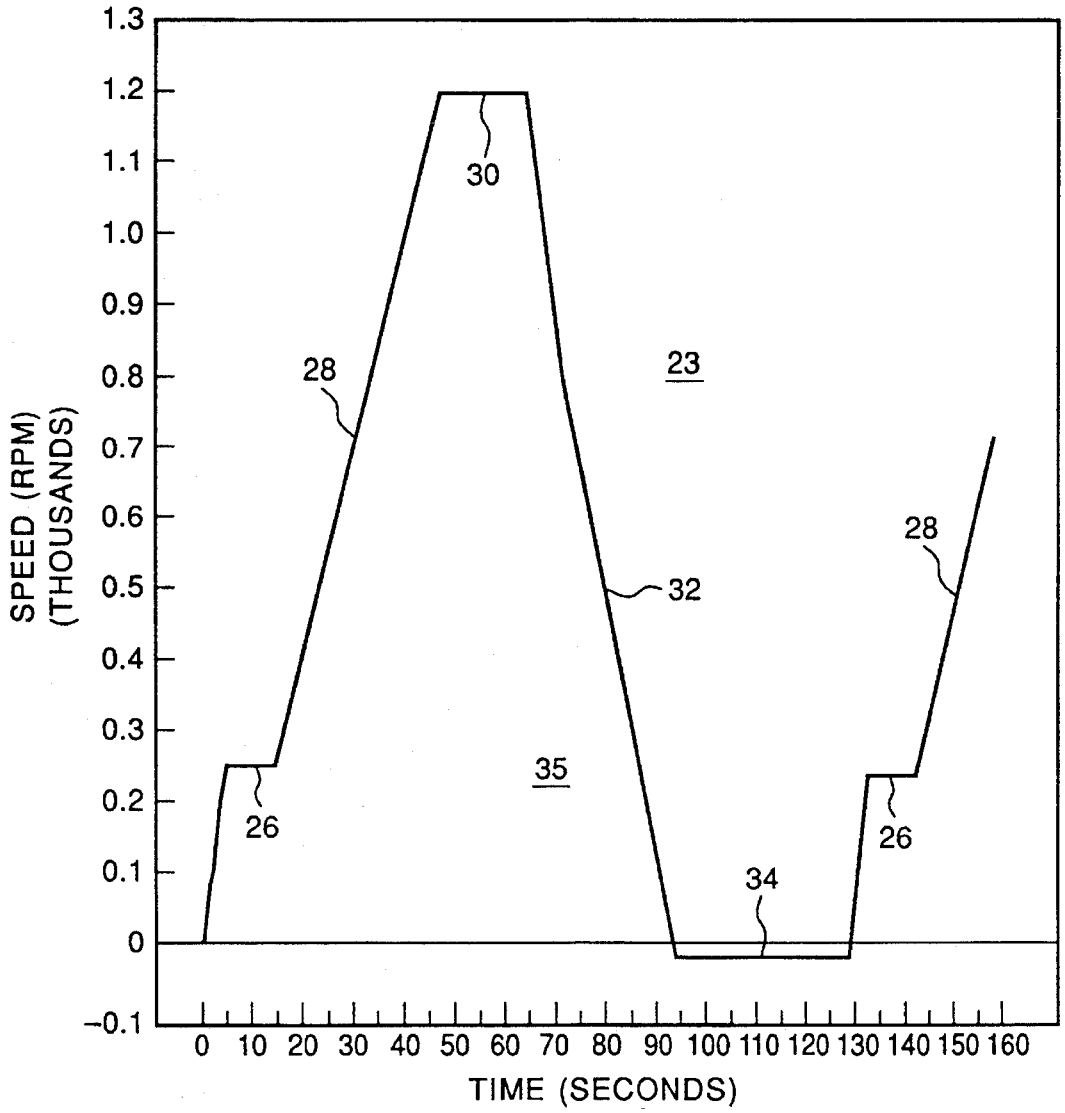
FIG. 6 is a graph of rpm versus time for an actual cycle of a centrifugal according to the present invention.

FIG. 5 shows a block diagram of a preferred embodiment of the present invention, and trace 35 in FIG. 6 is a graph of its cycle.

As shown in FIG. 5, an alternating current (AC) line 36 provides power to a plurality of centrifugal drive units 38. Preferably, each of the drive units is a Model 8804 Adjustable Frequency Controller Unit manufactured by the Square D Company of Raleigh, N.C.

Within each of the centrifugal drive units 38, the AC power is converted to DC power by an AC-DC converter 40 and fed to a DC bus 42 common to all drive units 38. This common DC bus structure 42 is essential to the dynamic regenerative braking capabilities of the present invention, as will be discussed in greater detail below.

Figure 1:
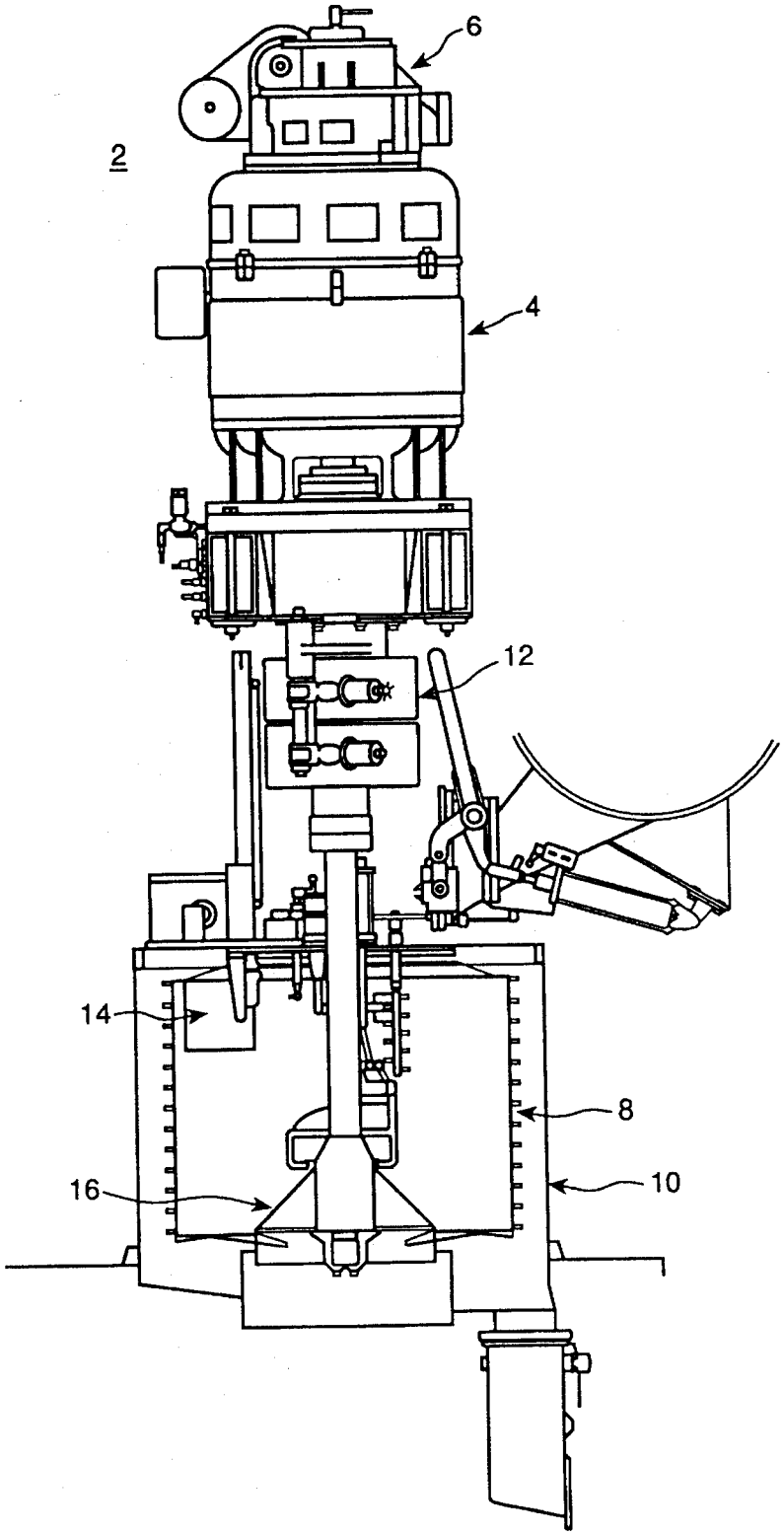
Fig. 1 (PRIOR ART)
FIG. 1 is a cross-sectional view of a conventional affination or white sugar centrifugal.
Figure 2:
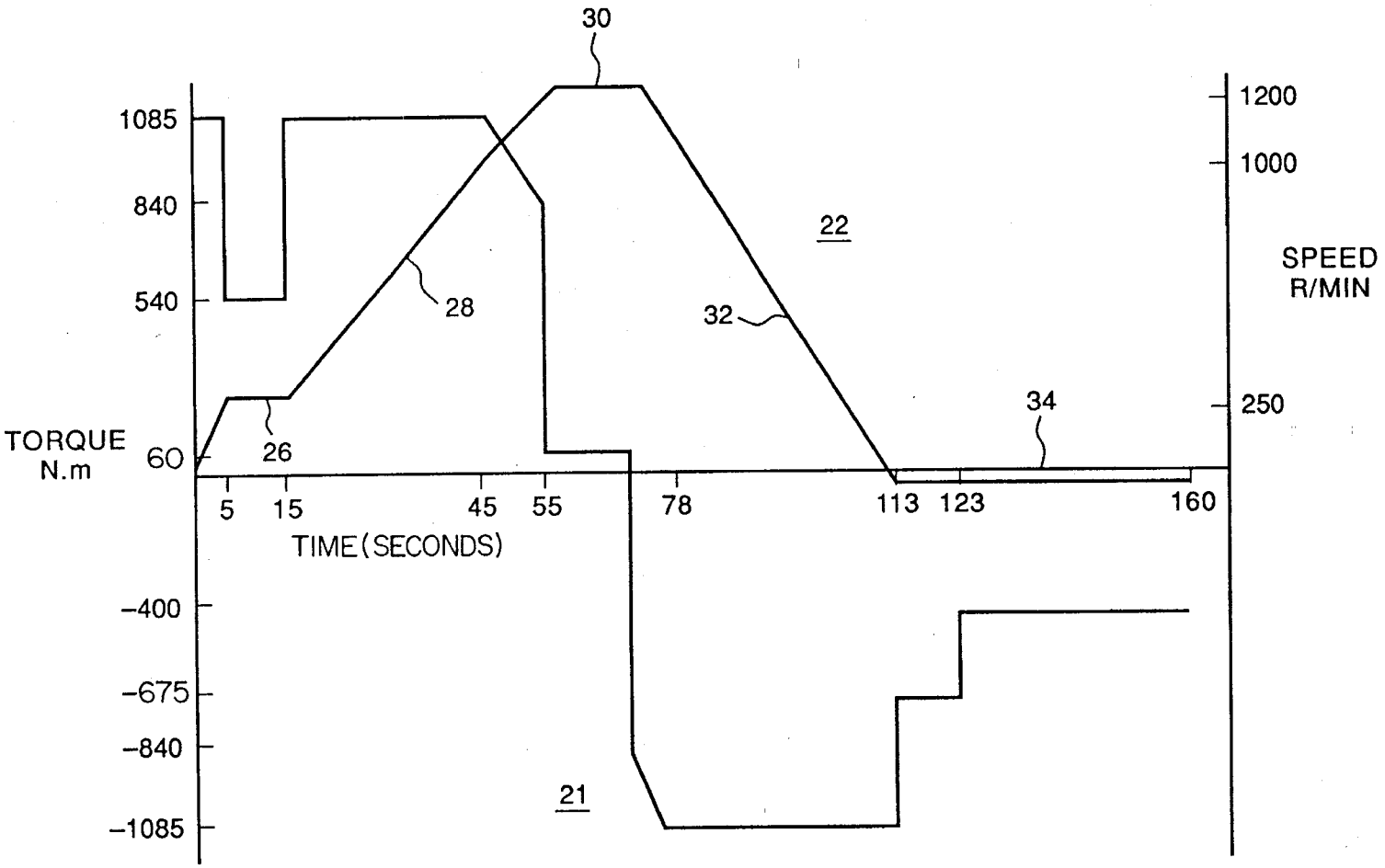
Fig. 2 (PRIOR ART)
FIG. 2 is a graph of rpm versus time and motor torque versus time for an idealized cycle for an affination centrifugal.
Figure 3:
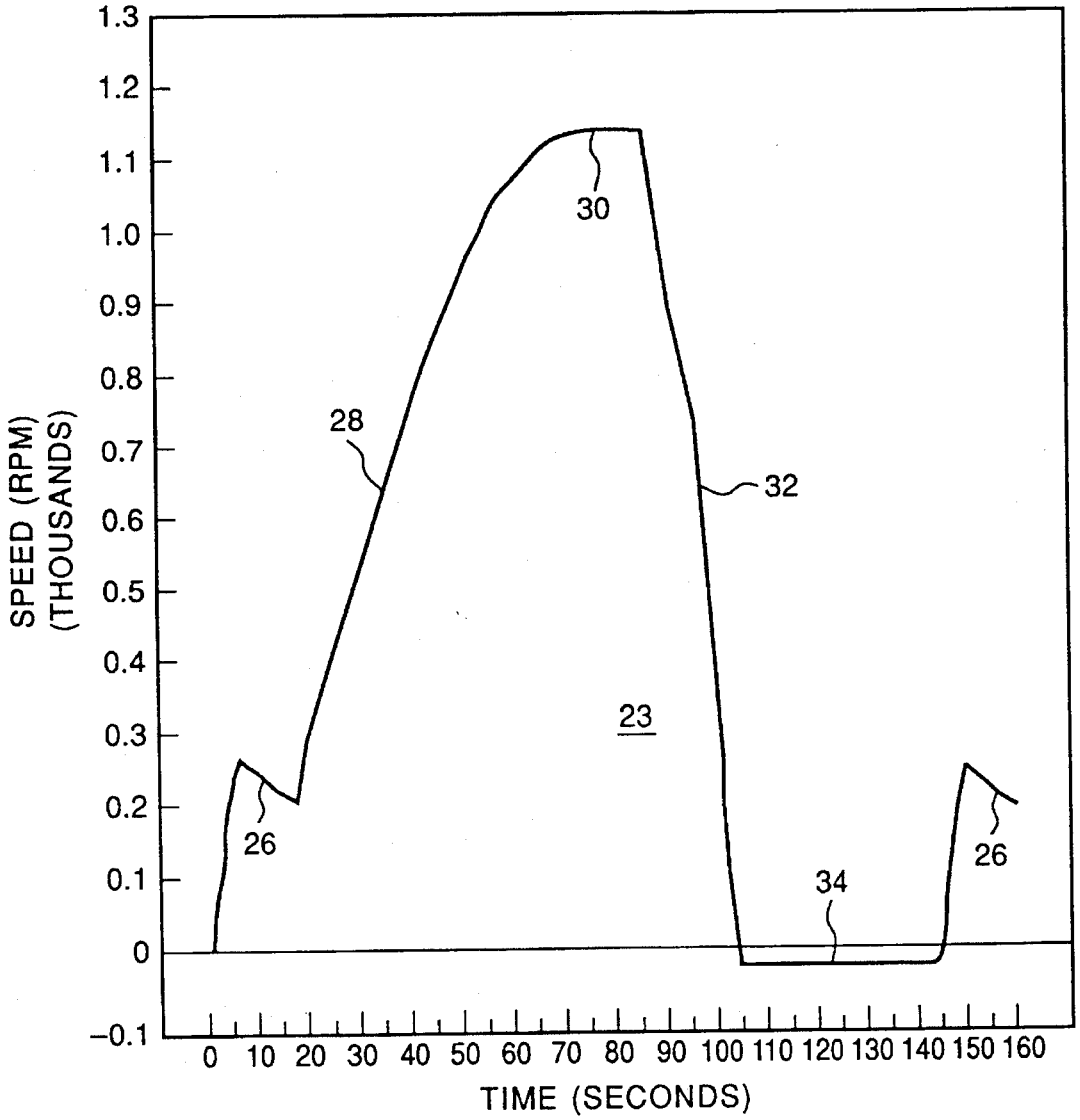
Fig. 3 (PRIOR ART)
FIG. 3 is a graph of rpm versus time for an actual cycle of a CSM centrifugal drive.
Figure 4:
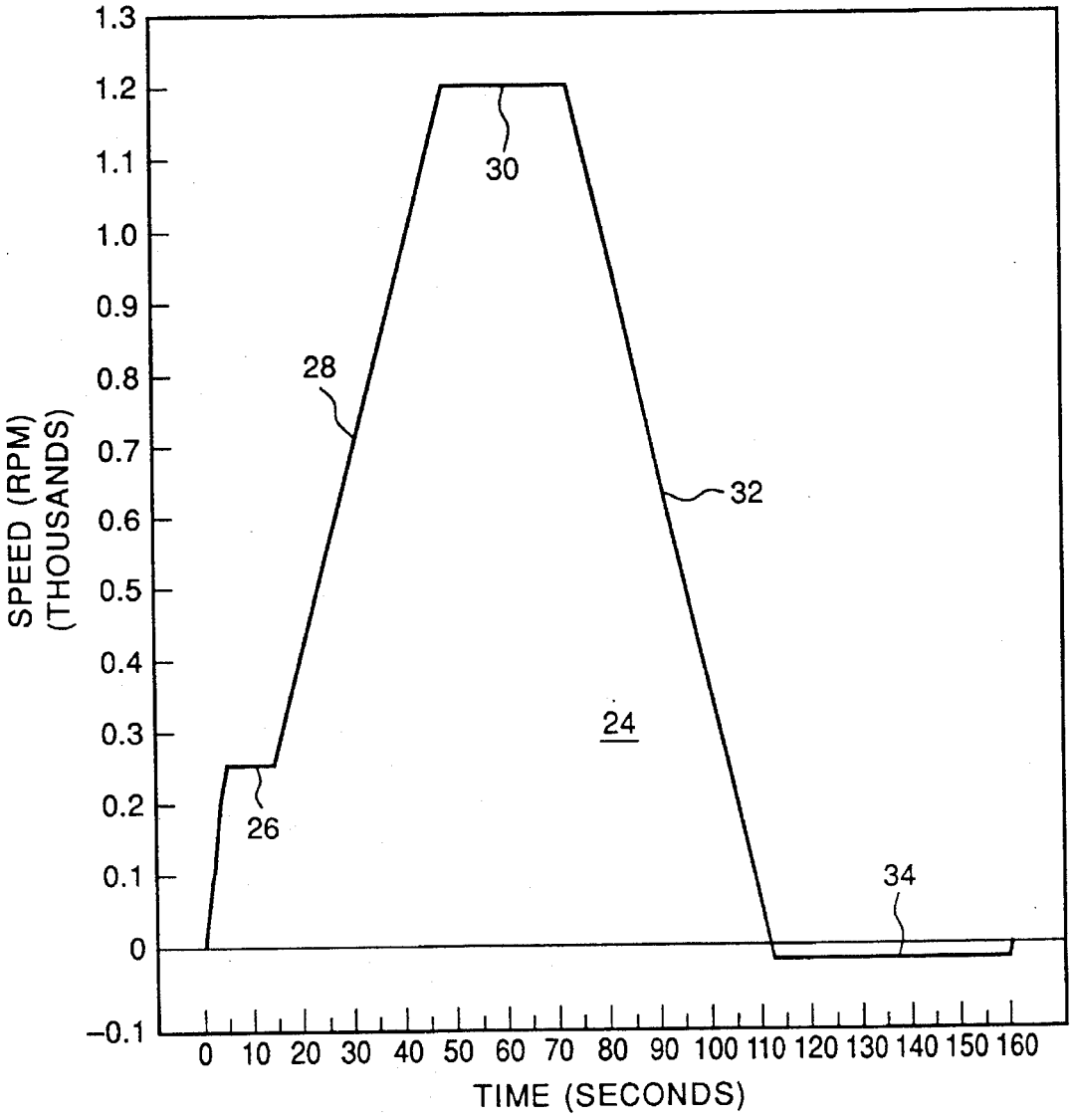
Fig. 4 (PRIOR ART)
FIG. 4 is a graph of rpm versus time for an actual cycle of a PWM centrifugal drive.

As is known in the art, regenerative braking uses back EMF signals generated by an electrical motor when it is decelerated to provide electrical energy to associated devices. In the context of multiple centrifugals in a sugar refinery or the like, regenerative braking energy from a centrifugal in the braking phase of its cycle may advantageously be used to power another centrifugal which is in its acceleration or spin phase over a common bus. That is, when the motor is being decelerated, its inertia causes it to spin faster than it would be able solely from the operative power applied thereto. This induces a back EMF in the motor, causing it to act as a generator and output electrical power. Using this braking scheme, the mechanical brake 12 shown in FIG. 1 can be eliminated.

In the above-described system utilizing a common DC bus 42, the cycle of each centrifugal advantageously is staggered relative to other units to most effectively use regenerative braking energy supplied to the common DC bus 42.

Within each drive unit 38, the DC bus 42 feeds a DC-AC inverter 44. The DC-AC inverter 44 converts DC power on the DC bus 42 to AC power to operate drive motor 6. The inverter 44 is responsive to a programmable logic controller (PLC) 46 which controls the inverter 44 to selectively provide a drive voltage to the drive motor 6. The PLC 46 receives as an input a signal representative of the voltage drop across a shunt resistor 48. Preferably, the shunt resistor 48 is of a small value such as 0.1 Ω resistor. By monitoring the voltage drop across the shunt resistor 48, the PLC 46 can effectively monitor the backfed EMF generated by the drive motor 6.

The PLC 46 runs a control program 50 which selectively applies driving voltages to the drive motor 6 based on its rotational speed. Preferably, the PLC 46 is a Model 450 Processor manufactured by the Square D company of Raleigh, N.C. Also, the control program preferably is written using a ladder logic program such as the one provided with the above-noted Model 450 processor. A copy of a preferred embodiment of a control program 50 used in a preferred embodiment of the present invention for one PLC 46 is shown in APPENDIX A.

Figure 7:
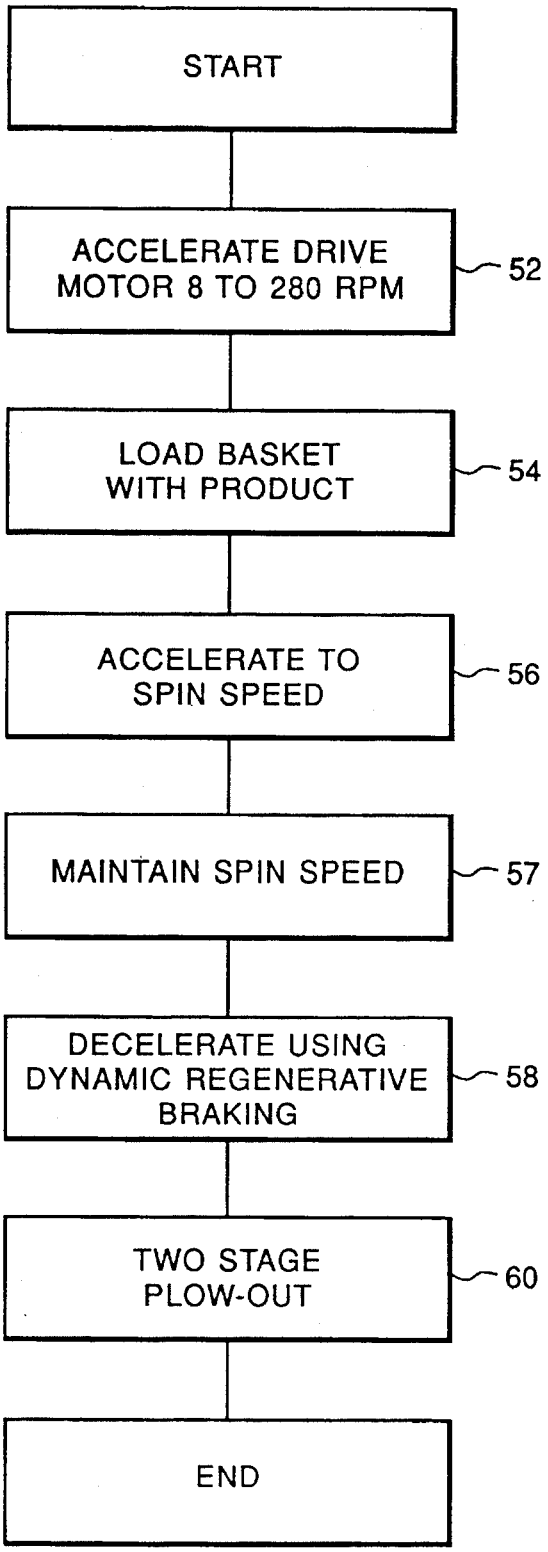
FIG. 7 is a flowchart showing the overall operation of a control program according to the present invention.

FIG. 7 is a flowchart showing the overall operation of the control program 50. At Step 52, the drive motor 6 is ramped up to 280 rpms. At Step 54, the basket 8 is loaded with approximately 830 pounds of massecuite or white sugar while maintaining the rotational speed of the drive motor 6 at 280 rpms. At Step 56, the drive motor is accelerated to 1200 rpm and at Step 57, it spins at this speed for 10 to 50 seconds depending on the type of sugar being processed.

Of particular interest in the context of the present invention are the last two steps in this process. In Step 58, the motor 6 is decelerated using a dynamic regenerative braking technique described in more detail below. In Step 60, the motor is driven in a two-stage dynamic plow-out operation to remove the finished product.

Figure 8:
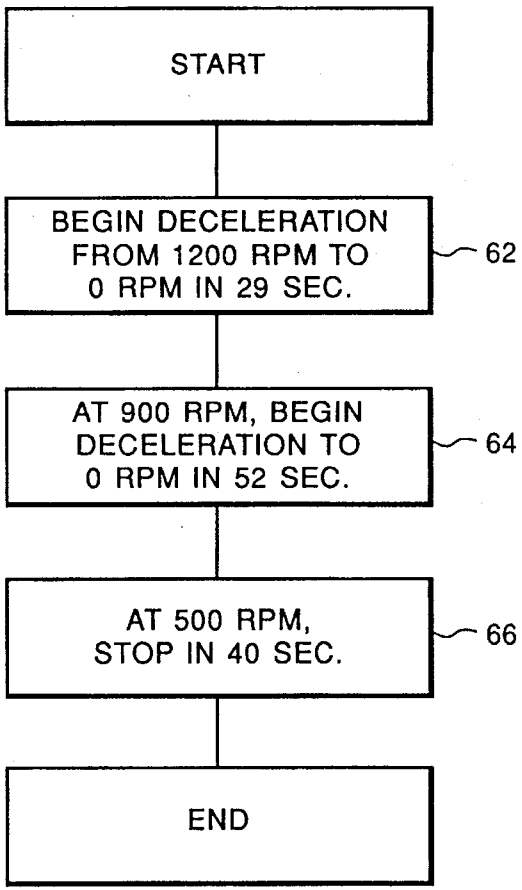
FIG. 8 is a flowchart showing the operation of a regenerative braking process according to the present invention.

FIG. 8 is a flowchart describing the regenerative braking process 58 in greater detail. In Step 62, a gradually decreasing voltage signal is applied to the motor 6. This signal is designed to reduce the speed of the motor 6 from 1200 rpm to a stationary position in 29 seconds; however, when the motor 6 reaches a rotational speed of 900 rpm, the PLC 46 applies another gradually decreasing voltage signal to the motor 6 in Step 62. This second signal is designed to further reduce the speed of the motor 6 from the aforementioned 900 rpm to a stationary position in 52 seconds. Again, this signal is not permitted to run its course. Instead, when the motor 6 reaches 500 rpm, a third voltage gradient is applied to the motor 6 to enable it to stop completely in 40 seconds in Step 64.

By using a segmented braking curve as described above rather than a constant straight line curve as in prior art systems, the particular dynamic braking characteristics of a particular drive motor can be advantageously matched to obtain the maximum amount of available braking torque at any given speed. Since the drive system is able to extract more braking torque from the motor 6 than usual, it is able to bring the motor 6 to a halt more quickly and consequently can begin the plow-out phase sooner.

Figure 9:
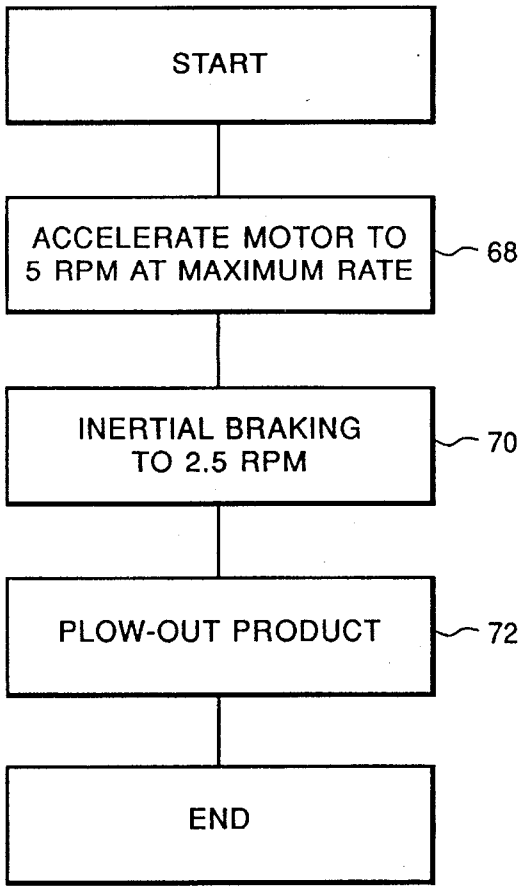
FIG. 9 is a flowchart showing a plow-out process according to the present invention.

FIG. 9 provides a more detailed description of the plow-out process 34 shown in FIG. 6. Once the motor 6 is stationary, the PLC 46 applies a gradually increasing voltage designed to accelerate the motor to 300 rpm at a maximum rate in Step 68. When the motor 6 reaches this speed, it is inertially braked to 150 rpm in Step 70, and the plow 14 is engaged in Step 72.

Preferably, the plow-out operation does not rely on the frequency feedback capabilities of the drive motor 6 to accurately gauge the rotational speed of the motor. Instead, it uses a speed switch to provide a true measurement of the motor's speed to the PLC 46.

In contrast to prior art systems which require that the motor 6 be driven to a relatively high speed to provide sufficient torque to accomplish a satisfactory plow-out operation, the present invention is able to increase the torque of the system when it is most needed while still allowing the system to perform the actual plow-out operation at a relatively low speed. In this way, the plow-out time can be significantly reduced while maintaining a thorough plow-out.

Surprising improvements in the centrifuging process can be realized with the present invention. For example, when compared with the present invention, prior art system require 74% more energy in terms of kilowatt-hour consumption, 60% more raw kilowatts, and 830% more KVAR-hours. The energy cost per cycle of a typical prior art system is about 9.21¢ per cycle, compared with 5.27¢ per cycle for the invention, a 74.6% increase.

Variations on the above-described preferred embodiments of this invention will be readily apparent to those skilled in the art. For example, as noted above, the present invention may be used not only to control affination centrifugals, but can be used in other phases of the refining process as well. For example, the invention can be used in a white sugar centrifugal with little modification other than increasing the length of the spin phase of the centrifugal cycle to allow the sugar to be dried sufficiently. Also, the invention is not limited to food refining application; rather, it can be used in any applications where dynamic motor braking is effective.

Although a few preferred embodiments of the invention have been shown and described, it will be appreciated by those skilled in the art that changes may be made in these embodiments without departing from the principles and the spirit of the invention, the scope of which is defined in the appended claims.

APPENDIX A

© 1994 Dwayne Zeigler

```
RUNG 0164                                                                                F8,G5,E5,H5

!SEQ     CYCLE  RECYCL                          RESET  EMERG. BELL                        SEQ.
!START   COMPLT  SEL.  MIXER  BELL              PUSH    STOP  DROP                        RUN
! #5      CR2   SWITCH AUX    DOWN              BUTTON #6     TIMER                        CR
! 0268   0170   0035   0004   0001              0035   0171   0173                         0170
+--] [-+--] [-+--] [-+--] [-+--] [-+--]/[-+--]/[-+--]/[-+------+------+--( )-
!  -05    -07    -01 !  -09    -15 !  -12    -05    -06                                  -01
!RUN     RECYCL       !             !
!PUSH     SEL.        !             !
!BUTTON SWITCH        !             !
! 0035   0035         !             !
+--] [-+--]/[-+------+      +      +      +      +      +      +      +
!  -04    -01         !             !
!AUTO    SEQ          !             !
!START   START        !             !
!CR       #5          !             !
! 0171   0268         !             !
+--] [-+--] [-+------+      +      +      +      +      +      +      +
!  -13    -05                      !
!SEQ.                               !
!RUN                                !
!CR                                 !
! 0170                              !
+--] [-+------+------+------+------+      +      +      +      +      +
!  -01
```

CROSS REFERENCE

```
I/O0170-01     SEQ.  RUN   CR
0164-] [-        0164-( )-        0165-] [-        0166-] [-        0167-] [-(02)

0168-] [-        0173-] [-        0176-] [-        0178-] [-        0184-]/[-

0188-] [-        0188-]/[-        0189-] [-        0189-]/[-        0193-] [-

0194-] [-        0195-] [-        0198-] [-        0202-]/[-        0204-] [-

0205-] [-        0208-] [-        0209-] [-        0214-] [-        0217-] [-

0220-] [-        0221-] [-        0223-] [-        0232-]/[-        0236-] [-

0236-]/[-        0240-]/[-        0241-]/[-        0550-] [-
```

```
RUNG 0165                    DRIVE RUN CONTACT                    F8,G5,E5,H5

!SEQ.   EMERG. BRAKE
!RUN     STOP   SOLEN                                                DRIVE
!CR     #6      VALVE                                                RUN
! 0170   0171   0005                                                 0302
+--] [-+--]/[-+--]/[-+------+------+------+------+------+------+------+--( )-
!  -01    -05 !  -11                                                 -01
!RECYCL JOG   !
! SEL.   PUSH !
!SWITCH BUTTON!
! 0035   0035 !
+--]/[-+--] [-+      +      +      +      +      +      +      +      +
!  -01 !  -07 !
!      !REV.  !
!      !LOCK  !
!      !CR    !
!      ! 0171 !
+      +--] [-+      +      +      +      +      +      +      +      +
!         -10
```

CROSS REFERENCE

```
I/00302-01     DRIVE RUN
0165-( )-        0216-]/[-
```

```
RUNG 0166                          S550                                F8,G5,E5,H5

!FILL
!BASKET
! CR
! 0170                                                                 *-TMR--*
+--] [-+------+------+------+------+------+------+------+------+------+!TIME  !
!  -04 !                                                               !      !
!REGEN !                                                               !      !
!BRAKE !                                                               !      !
! CR   !                                                               !      !
! 0170 !                                                               !      !
+--] [-+      +      +      +      +      +      +      +      +      +!S0350 !
!  -05                                                                 !      !
!SEQ.                  RESET                                           !      !
!RUN            DRIVE  PUSH                                            !      !
!CR             LOCK   BUTTON                                          !      !
! 0170   0186    0308   0035                                            !      !
+--] [-+--]/[-+--]/[-+--]/[-+------+------+------+------+------+------+!CLEAR !
!  -01    -03     -06 !  -12                                           !      !
!FILL                 !                                                !      !
!BASKET               !                                                !      !
! CR                  !                                                !      !
! 0170                !                                                !      !
+--] [-+------+------+      +      +      +      +      +      +      +! .1S  !
!  -04                                                                 !      !
!                                                                      !      !
+      +      +      +      +      +      +      +      +      +      +!      !
!                                                                      !      !
!                                                                      !      !
+      +      +      +      +      +      +      +      +      +      +!= 9999!
!                                                                      !      !
!                                                                      !CYCLE !
!                                                                      !TIMER !
!                                                                      ! 0185 !
+      +      +      +      +      +      +      +      +      +      +!--( )-!
!                                                                      *---01-*
```

CROSS REFERENCE

I/O0185-01 CYCLE TIMER
0166TIMER

S0350
0166TIMER 0176IF

```
RUNG 0167                                                                F8,G5,E5,H5

!SEQ.                          SEQ.   REGEN  OMIT   FILL                 LOW
!RUN                           RUN    BRAKE  LOAD   BASKET               SPEED
!CR                            CR      CR    BUTTON  CR                   CR
! 0170  *------------------*  0170   0170   0035   0170                 0170
+--] [-+ IF    S0307 < 1300++--] [-+--]/[-+--]/[-+--]/[-+------+------+--( )-
!  -01  *------------------*!  -01    -05    -11    -04                  -03
!LOW    OMIT   LOW          !
!SPEED  LOAD   SPEED        !
!CR     CR     CR           !
! 0170   0170   0170        !
+--] [-+--]/[-+--]/[-+------+      +      +      +      +      +      +
!  -03    -15    -16

CROSS REFERENCE

I/O0170-03    LOW   SPEED CR
0167-] [-       0167-( )-       0168-]/[-       0170-] [-       0171-] [-

0172-] [-       0194-] [-       0236-] [-       0242-] [-


RUNG 0168                                                                F8,G5,E5,H5

!LOW                                   LOW    REGEN  SEQ.                 FILL
!SPEED  BLISTE                         SPEED  BRAKE  RUN                  BASKET
!CR     R AUX                          CR     CR     CR                   CR
! 0170   0004  *------------------*  0170   0170   0170                 0170
+--] [-+--] [-+ IF    S0307 > 1390++--]/[-+--]/[-+--] [-+------+------+--( )-
!  -16 !  -10  *------------------*   -03    -05    -01                  -04
!OMIT  !
!LOAD  !
!CR    !
! 0170 !
+--] [-+      +      +      +      +      +      +      +      +      +
!  -15 !
!FILL  !
!BASKET!
! CR   !
! 0170 !
+--] [-+      +      +      +      +      +      +      +      +      +
!  -04

CROSS REFERENCE

I/O0170-04    FILL  BASKET CR
0166-] [-(02)   0167-]/[-       0168-] [-       0168-( )-       0169-] [-

0173-]/[-       0176-] [-       0196-] [-(02)   0197-] [-       0208-] [-

0236-] [-       0242-] [-       0550-] [-
```

```
RUNG 0169

!FILL   BRAKE
!BASKET  SOLEN
! CR     VALVE
! 0170   0005                                                 *------------------*
+--] [-+--]/[-+------+------+------+------+------+------+ LET   S0301 = 6000+
!  -04 !  -11                                                *------------------*
!JOG   !
!      !
!CR    !
! 0170 !
+--] [-+      +      +      +      +      +      +      +      +      +
!  -13

CROSS REFERENCE

S0301
0023WRITE        0169LET         0170LET         0215LET         0567LET
```

```
RUNG 0170

!LOW
!SPEED
!CR
! 0170                                                        *------------------*
+--] [-+------+------+------+------+------+------+------+ LET   S0301 = 1400+
!  -03                                                        *------------------*

CROSS REFERENCE

S0301
0023WRITE        0169LET         0170LET         0215LET         0567LET
```

```
RUNG 0171                                                                F8,G5,E5,H5

!       SEQ.          LOW                                                  GATE
!       AUTO   F WET  SPEED                                                 SOLEN
!SPARE  CR     SCROLL CR                                                    VALVE
! 0001   0170   0001   0170                                                 0005
+--] [-+--] [-+--] [-+--] [-+------+------+------+------+------+------+--( )-
!  -10    -02    -09    -03                                                 -12

CROSS REFERENCE

I/O0005-12     GATE   SOLEN VALVE
0171-( )-        0174-] [-       0222-] [-       0224-]/[-       0565-]/[-
```

```
RUNG 0172                                                                F7,G4,E4,H4

!       SEQ.   LOW
!       AUTO   SPEED
!SPARE  CR     CR                                                          SPARE
! 0001   0170   0170                                                        0005
+--] [-+--] [-+--] [-+------+------+------+------+------+------+------+--( )-
!  -10    -02    -03                                                        -16
```

CROSS REFERENCE

```
I/00005-16    SPARE
0172-( )-       0174-] [-
```

```
RUNG 0173                                                                F8,G5,E5,H5

!       RECYCL SEQ.   FILL   EMERG. LOW                                    SEQ.
!FREQ    SEL.  RUN    BASKET  STOP  SPEED                                  AUTO
!>1250  SWITCH CR      CR     #6    CR                                    CR
! 0172   0035   0170   0170   0171   0170  *------------------*            0170
+--] [-+--] [-+--] [-+--]/[-+--]/[-+--]/[-+ IF    S0307 > 1380++------+--( )-
!  -01 !  -01    -01 !  -04    -05    -16  *------------------*             -02
!      !LOAD   RECYCL!
!      ! PUSH   SEL. !
!      !BUTTON SWITCH!
!      ! 0035   0035 !
+      +--] [-+--]/[-+      +      +      +      +      +      +      +
!         -08    -01 !
!SEQ.                !
!AUTO                !
!CR                  !
! 0170                !
+--] [-+------+------+      +      +      +      +      +      +      +
!  -02
```

CROSS REFERENCE

```
I/00170-02    SEQ.  AUTO  CR
0171-] [-       0172-] [-       0173-] [-       0173-( )-       0174-] [-

0175-] [-
```

```
RUNG 0174

!       GATE          SEQ.
!        SOLEN BLISTE AUTO
!SPARE   VALVE R AUX  CR
! 0005   0005   0004   0170                                                0170
+--] [-+--] [-+--]/[-+--] [-+------+------+------+------+------+------+--( )-
!  -16    -12    -10 !  -02                                                -11
! 0170               !
+--] [-+------+------+      +      +      +      +      +      +      +
!  -11

CROSS REFERENCE

I/00170-11
0174-] [-       0174-( )-       0175-] [-


RUNG 0175                                                          F8,G5,E5,H5

!              SEQ.                                                   LOW
!       BLISTE AUTO                                                   SPEED
!       R AUX  CR                                                     CR
! 0170   0004   0170                                                   0170
+--] [-+--] [-+--] [-+------+------+------+------+------+------+------+--( )-
!  -11    -10    -02 !                                                  -16
!OMIT   RECYCL       !
!LOAD    SEL.        !
!CR     SWITCH       !
! 0170   0035        !
+--] [-+--]/[-+------+      +      +      +      +      +      +      +
!  -15    -01

CROSS REFERENCE

I/00170-16    LOW   SPEED CR
0167-]/[-       0168-] [-       0173-]/[-       0175-( )-
```

```
RUNG 0176                                                                F8,G5,E5,H5

!                              EMERG. SEQ.                                   REGEN
!                               STOP  RUN    DRIVE                           BRAKE
!                              #6     CR     LOCK                             CR
!*-------------------------*  0171   0170   0308                            0170
+ IF    S0350 > 0240 +S0471++--]/[-+--] [-+--]/[-+------+------+------+--( )-
!*-------------------------*!  -05    -01    -06                              -05
!RECYCL REGEN                 !
! SEL.  BRAKE                 !
!SWITCH  CR                   !
! 0035   0170                 !
+--] [-+--] [-+------+------+      +      +      +      +      +      +
!  -01    -05                 !
!REGEN                        !
!BRAKE                        !
! CR                           !
! 0170                         !
+--] [-+------+------+------+      +      +      +      +      +      +
!  -05                         !
!RESET  FILL                  !
!PUSH   BASKET                !
!BUTTON  CR                   !
! 0035   0170                 !
+--] [-+--] [-+------+------+      +      +      +      +      +      +
!  -12    -04

CROSS REFERENCE

I/O0170-05    REGEN BRAKE  CR
0166-] [-       0167-]/[-       0168-]/[-       0176-] [-(02)   0176-( )-

0209-] [-       0219-] [-       0237-] [-
```

```
RUNG 0177                                                                F8,G5,E5,H5

!EMERG.                                                                     BRAKE
! STOP  RESET                                                                SOLEN
!#6     CR                                                                  VALVE
! 0171   0172                                                               0005
+--] [-+--]/[-+------+------+------+------+------+------+------+------+--( )-
!  -05    -02        !                                                        -11
!*-----------------*!
+ IF    S0380 > 0210++      +      +      +      +      +      +      +
!*-----------------*

CROSS REFERENCE

I/O0005-11    BRAKE  SOLEN VALVE
0165-]/[-       0169-]/[-       0177-( )-
```

```
RUNG 0178

!BELL   BELL   SEQ.   EMERG.
!HOLD   DROP   RUN     STOP  DRIVE  REVERS
!TIMER  TIMER  CR     #6     LOCK   CR
! 0173   0173   0170   0171   0308   0302                                0172
+--] [-+--]/[-+--] [-+--]/[-+--]/[-+--] [-+------+------+------+------+--( )-
!  -05 !  -06    -01    -05 !  -06 !  -02 !                            -10
!      !                    !      !VALVE !
!      !                    !      ! SEL. !
!      !                    !      !SWITCH!
! 0172 !                    !      ! 0035 !
+--] [-+      +      +      +      +--] [-+      +      +      +      +
!  -10                      !         -03
!RECYCL VALVE               !
! SEL.   SEL.               !
!SWITCH SWITCH              !
! 0035   0035               !
+--]/[-+--] [-+------+------+      +      +      +      +      +      +
!  -01 !  -03               !
!      !REV.                !
!      !LOCK                !
!      !CR                  !
!      ! 0171               !
+      +--] [-+------+------+      +      +      +      +      +      +
!         -10
```

CROSS REFERENCE

```
I/O0172-10
0178-] [-       0178-( )-       0180-]/[-       0181-] [-       0182-] [-

0182-]/[-       0567-] [-
```

```
RUNG 0179                                                          F8,G5,E5,H5

!                                                                   BELL
!                                                                    SOLEN
!                                                                    VALVE
! 0173                                                               0005
+--] [-+------+------+------+------+------+------+------+------+------+--( )-
!  -13                                                                -13
```

CROSS REFERENCE

```
I/O0005-13     BELL   SOLEN VALVE
0179-( )-       0193-] [-       0230-] [-
```

```
RUNG 0180

!        SPARE
! 0172    0001                                                          0173
+--]/[-+--] [-+------+------+------+------+------+------+------+------+--(U)-
!  -10     -14                                                           -13

CROSS REFERENCE

I/00173-13
0179-] [-        0180-(U)-        0181-(L)-


RUNG 0181

!        SPARE
! 0172    0001                                                          0173
+--] [-+--] [-+------+------+------+------+------+------+------+------+--(L)-
!  -10     -14                                                           -13

CROSS REFERENCE

I/00173-13
0179-] [-        0180-(U)-        0181-(L)-


RUNG 0182

!        SPARE
! 0172    0004                                                          0173
+--] [-+--] [-+------+------+------+------+------+------+------+------+--( )-
!  -10     -06         !                                                 -15
!        H WET   MIXER !
!        SCREW   AUX   !
! 0172    0004    0004 !
+--]/[-+--]/[-+--]/[-+      +      +      +      +      +      +      +
!  -10     -07     -09

CROSS REFERENCE

I/00173-15
0182-( )-        0183-]/[-


RUNG 0183                        SPARE

!                                                                     SPARE
! 0173                                                                 0008
+--]/[-+------+------+------+------+------+------+------+------+------+--( )-
!  -15                                                                  -02

CROSS REFERENCE
```

```
I/00008-02     SPARE
0183-( )-


RUNG 0184                                                                F8,G5,E5,H5

!BELL   SEQ.                                                                CYCLE
!DROP   RUN                                                                 COMPLT
!TIMER  CR                                                                   CR1
! 0173   0170                                                               0170
+--] [-+--]/[-+------+------+------+------+------+------+------+------+--( )-
!  -06 !  -01                                                                -06
!CYCLE !
!COMPLT!
! CR1  !
! 0170 !
+--] [-+      +      +      +      +      +      +      +      +      +
!  -06

CROSS REFERENCE

I/00170-06     CYCLE COMPLT CR1
0184-] [-        0184-( )-        0185-] [-


RUNG 0185                                                                F8,G5,E5,H5

!CYCLE                                                                      CYCLE
!COMPLT                                                                     COMPLT
! CR1                                                                        CR2
! 0170                                                                      0170
+--] [-+------+------+------+------+------+------+------+------+------+--( )-
!  -06                                                                       -07

CROSS REFERENCE

I/00170-07     CYCLE COMPLT CR2
0164-] [-        0185-( )-        0186-] [-
```

```
RUNG 0186                    DRIVE FAIL BLINK                    F8,G5,E5,H5

!CYCLE
!COMPLT                                                            CYCLE
! CR2                                                              LIGHT
! 0170                                                              0072
+--] [-+------+------+------+------+------+------+------+------+--( )-
!  -07 !                                                            -09
!PULSE !
!TIMER !
!#1    !
! 0185 !
+--] [-+      +      +      +      +      +      +      +      +      +
!  -08

CROSS REFERENCE

I/00072-09     CYCLE LIGHT
0186-( )-
```

```
RUNG 0187                          S553                                F8,G5,E5,H5

!REV
!CR
! 0172                                                                 *-TMR--*
+--] [-+------+------+------+------+------+------+------+------+------+!TIME  !
!  -03                                                                 !      !
!                                                                      !      !
+      +      +      +      +      +      +      +      +      +      +!S0353 !
!                                                                      !      !
!REV                                                                   !      !
!CR                                                                    !      !
! 0172                                                                 !      !
+--] [-+------+------+------+------+------+------+------+------+------+!CLEAR !
!  -03                                                                 !      !
!                                                                      !      !
+      +      +      +      +      +      +      +      +      +      +! .1S  !
!                                                                      !      !
!                                                                      !      !
+      +      +      +      +      +      +      +      +      +      +!      !
!                                                                      !      !
!                                                                      !      !
+      +      +      +      +      +      +      +      +      +      +!= 0100!
!                                                                      !      !
!                                                                      !PLOW  !
!                                                                      !OUT   !
!                                                                      !TIMER !
!                                                                      ! 0185 !
+      +      +      +      +      +      +      +      +      +      +!--( )-!
!                                                                      *---03-*
```

CROSS REFERENCE

```
I/00185-03     PLOW  OUT   TIMER
0187TIMER        0205-] [-

S0353
0187TIMER
```

```
RUNG 0188                          PLOW IN OR OUT                      F8,G5,E5,H5

!IN/OUT RECYCL SEQ.                                                      DSV2
! SEL.   SEL.  RUN                                                       SOLEN
!SWITCH SWITCH CR                                                        VALVE
! 0035   0035   0170                                                     0005
+--] [-+--]/[-+--]/[-+------+------+------+------+------+------+------+--( )-
!  -02    -01    -01                                                     -15
!                                          SEQ.  !
!                                          RUN   !
!                                          CR    !
!*-----------------* *-----------------*  0170 !
+ IF    S0380 > 0012++ IF    S0380 < 0155++--] [-+      +      +      +
!*-----------------* *-----------------*   -01
```

CROSS REFERENCE

```
I/00005-15     DSV2   SOLEN VALVE
0188-( )-        0207-]/[-(02)    0221-] [-
```

```
RUNG 0189                        PLOW UP OR DOWN                          F8,G5,E5,H5

!UP/DWN                 RECYCL SEQ.                                          DSV1
! SEL.          DRIVE   SEL.  RUN                                           SOLEN
!SWITCH SPARE  LOCK   SWITCH CR                                             VALVE
! 0035   0004   0308   0035   0170                                          0005
+--] [-+--]/[-+--]/[-+--]/[-+--]/[-+------+------+------+------+------+--( )-
!  -06    -06    -06    -01    -01                        !                -14
!                                            SEQ.   PLOW  !
!                                            RUN    DOWN  !
!                                            CR     LS    !
!*------------------* *------------------*  0170   0001 !
+ IF    S0380 > 0040++ IF    S0380 < 0210++--] [-+--] [-+      +      +
!*------------------* *------------------*   -01    -13

CROSS REFERENCE

I/00005-14     DSV1   SOLEN VALVE
0189-( )-
```

```
RUNG 0190                                                                   F8,G5,E5,H5

!RECYCL JOG                                                                    JOG
! SEL.   PUSH
!SWITCH BUTTON                                                                 CR
! 0035   0035                                                                  0170
+--]/[-+--] [-+------+------+------+------+------+------+------+------+--( )-
!  -01    -07                                                                  -13

CROSS REFERENCE

I/00170-13     JOG          CR
0169-] [-        0190-( )-
```

```
RUNG 0191                    S558                                F8,G5,E5,H5

!DRIVE
!LOCK
! 0308                                                          *-TMR--*
+--] [-+------+------+------+------+------+------+------+------+!TIME  !
!  -06                                                          !      !
!                                                               !      !
+      +      +      +      +      +      +      +      +      +!S0358 !
!                                                               !      !
!       PULSE                                                   !      !
!DRIVE  TIMER                                                   !      !
!LOCK   #2                                                      !      !
! 0308   0185                                                   !      !
+--] [-+--]/[-+------+------+------+------+------+------+------+!CLEAR !
!  -06    -09                                                  !      !
!                                                               !      !
+      +      +      +      +      +      +      +      +      +! .1S  !
!                                                               !      !
!                                                               !      !
+      +      +      +      +      +      +      +      +      +!      !
!                                                               !      !
!                                                               !      !
+      +      +      +      +      +      +      +      +      +!= 0005!
!                                                               !      !
!                                                               !PULSE !
!                                                               !TIMER !
!                                                               !#1    !
!                                                               ! 0185 !
+      +      +      +      +      +      +      +      +      +!--( )-!
!                                                               *---08-*
```

CROSS REFERENCE

```
I/00185-08     PULSE TIMER #1
0186-] [-        0191TIMER        0192-] [-

S0358
0191TIMER
```

```
RUNG 0192                          S559                                F8,G5,E5,H5

!PULSE
!TIMER
!#1
! 0185                                                                 *-TMR--*
+--] [-+------+------+------+------+------+------+------+------+------+!TIME  !
!  -08                                                                 !      !
!                                                                      !      !
+      +      +      +      +      +      +      +      +      +      +!S0359 !
!                                                                      !      !
!PULSE                                                                 !      !
!TIMER                                                                 !      !
!#2                                                                    !      !
! 0185                                                                 !      !
+--]/[-+------+------+------+------+------+------+------+------+------+!CLEAR !
!  -09                                                                 !      !
!                                                                      !      !
+      +      +      +      +      +      +      +      +      +      +!  .1S !
!                                                                      !      !
!                                                                      !      !
+      +      +      +      +      +      +      +      +      +      +!      !
!                                                                      !      !
!                                                                      !      !
+      +      +      +      +      +      +      +      +      +      +!= 0005!
!                                                                      !      !
!                                                                      !PULSE !
!                                                                      !TIMER !
!                                                                      !#2    !
!                                                                      ! 0185 !
+      +      +      +      +      +      +      +      +      +      +!--( )-!
!                                                                      *---09-*
```

CROSS REFERENCE

```
I/00185-09     PULSE TIMER #2
0191-]/[-        0192-]/[-        0192TIMER


S0359
0192TIMER
```

```
RUNG 0193                          S554                                F8,G5,E5,H5

!BELL
! SOLEN
! VALVE
! 0005                                                                 *-TMR--*
+--] [-+------+------+------+------+------+------+------+------+------+!TIME  !
!  -13                                                                 !      !
!                                                                      !      !
+      +      +      +      +      +      +      +      +      +      +!S0354 !
!                                                                      !      !
!SEQ.                                                                  !      !
!RUN                                                                   !      !
!CR                                                                    !      !
! 0170                                                                 !      !
+--] [-+------+------+------+------+------+------+------+------+------+!CLEAR !
!  -01                                                                 !      !
!                                                                      !      !
+      +      +      +      +      +      +      +      +      +      +! .1S  !
!                                                                      !      !
!                                                                      !      !
+      +      +      +      +      +      +      +      +      +      +!      !
!                                                                      !      !
!                                                                      !      !
+      +      +      +      +      +      +      +      +      +      +!= 9999!
!                                                                      !      !
!                                                                      !DILUTI!
!                                                                      !ON    !
!                                                                      !TIMER !
!                                                                      ! 0185 !
+      +      +      +      +      +      +      +      +      +      +!--( )-!
!                                                                      *---04-*
```

CROSS REFERENCE

I/O0185-04 DILUTION TIMER
0193TIMER

S0354
0193TIMER

```
RUNG 0194                                                              F8,G5,E5,H5

!SEQ.   LOW                                                  RECYCL        WASH
!RUN    SPEED                                                 SEL.         WATER
!CR     CR                                                   SWITCH         CR1
! 0170   0170  *------------------* *------------------*  0035           0170
+--] [-+--] [-+ IF    S0307 > 0500++ IF    S0307 < 1000++--] [-+------+--( )-
!  -01    -03  *------------------* *------------------*   -01            -08
```

CROSS REFERENCE

I/O0170-08 WASH WATER CR1
0194-( )- 0195-] [- 0199-] [- 0200-] [-

```
RUNG 0195                          S555                                  F8,G5,E5,H5

!WASH
!WATER
! CR1
! 0170                                                                  *-TMR--*
+--] [-+------+------+------+------+------+------+------+------+------+!TIME  !
!  -08                                                                  !      !
!                                                                       !      !
+      +      +      +      +      +      +      +      +      +      +!S0355 !
!                                                                       !      !
!SEQ.                                                                   !      !
!RUN                                                                    !      !
!CR                                                                     !      !
! 0170                                                                  !      !
+--] [-+------+------+------+------+------+------+------+------+------+!CLEAR !
!  -01                                                                  !      !
!                                                                       !      !
+      +      +      +      +      +      +      +      +      +      +! .1S  !
!                                                                       !      !
!                                                                       !      !
+      +      +      +      +      +      +      +      +      +      +!      !
!                                                                       !      !
!                                                                       !      !
+      +      +      +      +      +      +      +      +      +      +!= 9999!
!                                                                       !      !
!                                                                       !WASH  !
!                                                                       !WATER !
!                                                                       !TIMER1!
!                                                                       ! 0185 !
+      +      +      +      +      +      +      +      +      +      +!--( )-!
!                                                                       *---05-*
```

CROSS REFERENCE

I/00185-05 WASH WATER TIMER1
0195TIMER

S0355
0195TIMER

```
RUNG 0196                          S556                                F8,G5,E5,H5

!FILL
!BASKET
! CR
! 0170                                                                 *-TMR--*
+--] [-+------+------+------+------+------+------+------+------+------+!TIME  !
!  -04                                                                 !      !
!                                                                      !      !
+      +      +      +      +      +      +      +      +      +      +!S0356 !
!                                                                      !      !
!FILL                                                                  !      !
!BASKET                                                                !      !
! CR                                                                   !      !
! 0170                                                                 !      !
+--] [-+------+------+------+------+------+------+------+------+------+!CLEAR !
!  -04                                                                 !      !
!                                                                      !      !
+      +      +      +      +      +      +      +      +      +      +! .1S  !
!                                                                      !      !
!                                                                      !      !
+      +      +      +      +      +      +      +      +      +      +!      !
!                                                                      !      !
!                                                                      !      !
+      +      +      +      +      +      +      +      +      +      +!= 0150!
!                                                                      !      !
!                                                                      !WASH  !
!                                                                      !WATER !
!                                                                      !TIMER2!
!                                                                      ! 0185 !
+      +      +      +      +      +      +      +      +      +      +!--( )-!
!                                                                      *---06-*
```

CROSS REFERENCE

I/00185-06 WASH WATER TIMER2
0196TIMER

S0356
0196TIMER

```
RUNG 0197                                                                  FP G5,E5,H5

!                                                          FILL   EMERG. WASH
!                                                          BASKET  STOP  WATER
!                                                           CR     #6     CR2
!*-------------------------* *-------------------------*  0170   0171   0170
+ IF    S0381 >S2004 x 0010++ IF    S0357 <S2001 x 0010++--] [-+--]/[-+--( )-
!*-------------------------*!*-------------------------*   -04    -05    -09
!WASH                       !
!WATER                      !
! CR2                       !
! 0170                      !
+--] [-+------+------+------+      +      +      +      +      +      +
!  -09
```

CROSS REFERENCE

```
I/00170-09    WASH  WATER  CR2
0197-] [-       0197-( )-       0198-] [-       0199-] [-
```

```
RUNG 0198                          S557                                F8,G5,E5,H5

!WASH
!WATER
! CR2
! 0170                                                                 *-TMR--*
+--] [-+------+------+------+------+------+------+------+------+------+!TIME  !
!  -09                                                                 !      !
!                                                                      !      !
+      +      +      +      +      +      +      +      +      +      +!S0357 !
!                                                                      !      !
!SEQ.                                                                  !      !
!RUN                                                                   !      !
!CR                                                                    !      !
! 0170                                                                 !      !
+--] [-+------+------+------+------+------+------+------+------+------+!CLEAR !
!  -01                                                                 !      !
!                                                                      !      !
+      +      +      +      +      +      +      +      +      +      +! .1S  !
!                                                                      !      !
!                                                                      !      !
+      +      +      +      +      +      +      +      +      +      +!      !
!                                                                      !      !
!                                                                      !      !
+      +      +      +      +      +      +      +      +      +      +!= 9999!
!                                                                      !      !
!                                                                      !WASH  !
!                                                                      !WATER !
!                                                                      !TIMER3!
!                                                                      ! 0185 !
+      +      +      +      +      +      +      +      +      +      +!--( )-!
!                                                                      *---07-*
```

CROSS REFERENCE

```
I/00185-07     WASH  WATER TIMER3
0198TIMER        0268TIMER


S0357
0197IF           0198TIMER
```

```
RUNG 0199                                                                F8,G5,E5,H5

!WASH                                                                       WASH
!WATER                                                                      WATER
! CR1                                                                       SOLEN
! 0170                                                                      0005
+--] [-+------+------+------+------+------+------+------+------+------+--( )-
!  -08        !                                                             -10
!WASH         !
!WATER        !
! CR2          !
! 0170         !
+--] [-+------+      +      +      +      +      +      +      +      +
!  -09        !
!WASH   WASH  !
!SELECT OUT   !
! SWTCH CR    !
! 0035   0173 !
+--] [-+--] [-+      +      +      +      +      +      +      +      +
!  -10    -07

CROSS REFERENCE

I/00005-10    WASH  WATER SOLEN
0199-( )-
```

```
RUNG 0200                      GATE   WASH SOLENOID VALVE                F8,G5,E5,H5

!WASH                                                                       GATE
!WATER                                                                       WASH
! CR1                                                                        SV
! 0170                                                                       0005
+--] [-+------+------+------+------+------+------+------+------+------+--( )-
!  -08                                                                       -09

CROSS REFERENCE

I/00005-09    GATE   WASH  SV
0200-( )-
```

```
RUNG 0201                                                                F8,G5,E5,H5

!OMIT                                                                       OMIT
!LOAD                                                                       LOAD
!BUTTON                                                                     CR
! 0035                                                                      0170
+--] [-+------+------+------+------+------+------+------+------+------+--(L)-
!  -11                                                                       -15

CROSS REFERENCE

I/00170-15    OMIT  LOAD  CR
0167-]/[-       0168-] [-       0175-] [-       0201-(L)-       0202-(U)-
```

```
RUNG 0202                                                                F8,G5,E5,H5

!SEQ.                                                                       OMIT
!RUN                                                                        LOAD
!CR                                                                         CR
! 0170                                                                       0170
+--]/[-+------+------+------+------+------+------+------+------+------+--(U)-
!  -01 !                                                                     -15
!RESET !
!PUSH  !
!BUTTON!
! 0035 !
+--] [-+      +      +      +      +      +      +      +      +      +
!  -12

CROSS REFERENCE

I/00170-15     OMIT  LOAD  CR
0167-]/[-       0168-] [-       0175-] [-       0201-(L)-       0202-(U)-
```

```
RUNG 0203                                                                                F8,G5,F5,H5

!STOP   RESET                                                                          EMERG.
!PUSH   PUSH                                                                            STOP
!BUTTON BUTTON                                                                         #6
! 0035   0035                                                                          0171
+--] [-+--]/[-+------+------+------+------+------+------+------+------+--( )-
!  -16 !  -12                                                                           -05
!EMERG.!
! STOP !
!#6    !
! 0171 !
+--] [-+      +      +      +      +      +      +      +      +      +
!  -05 !
!SPARE !
! 0001 !
+--] [-+      +      +      +      +      +      +      +      +      +
!  -06 !
!SILENC!
!E BUTT!
!ON    !
! 0004 !
+--] [-+      +      +      +      +      +      +      +      +      +
!  -08 !
! 0172 !
+--] [-+      +      +      +      +      +      +      +      +      +
!  -14
```

CROSS REFERENCE

```
I/O0171-05     EMERG. STOP #6
0164-]/[-        0165-]/[-        0173-]/[-        0176-]/[-        0177-] [-

0178-]/[-        0197-]/[-        0203-] [-        0203-( )-        0206-]/[-

0222-]/[-        0224-]/[-        0232-] [-
```

```
RUNG 0204

!PLOW
!COMPLT
!   CR
! 0170                                                          *-TMR--*
+--] [-+-------+-------+-------+-------+-------+-------+-------+-------+!TIME  !
!  -12                                                            !      !
!                                                                 !      !
+      +      +      +      +      +      +      +      +      +  +!S0369 !
!                                                                 !      !
!PLOW   SEQ.                                                      !      !
!COMPLT RUN                                                       !      !
!   CR  CR                                                        !      !
! 0170   0170                                                     !      !
+--] [-+--] [-+-------+-------+-------+-------+-------+-------+-------+!CLEAR !
!  -12    -01                                                     !      !
!                                                                 !      !
+      +      +      +      +      +      +      +      +      +  +!.01S  !
!                                                                 !      !
!                                                                 !      !
+      +      +      +      +      +      +      +      +      +  +!      !
!                                                                 !      !
!                                                                 !      !
+      +      +      +      +      +      +      +      +      +  +!= 1000!
!                                                                 !      !
!                                                                 ! 0186 !
+      +      +      +      +      +      +      +      +      +  +!--( )-!
!                                                                 *---03-*

CROSS REFERENCE

I/O0186-03
0166-]/[-       0204TIMER       0205-]/[-


S0369
0204TIMER


RUNG 0205                      PLOW OUT COMPLETE                    F8,G5,E5,H5

!PLOW           SEQ.                                                PLOW
!OUT            RUN                                                 COMPLT
!TIMER          CR                                                     CR
! 0185   0186   0170                                                0170
+--] [-+--]/[-+--] [-+-------+-------+-------+-------+-------+-------+--( )-
!  -03 !  -03    -01                                                 -12
!PLOW  !
!COMPLT!
!   CR !
! 0170 !
+--] [-+      +      +      +      +      +      +      +      +      +
!  -12

CROSS REFERENCE
```

```
I/00170-12     ρLOW  COMPLT   CR
0204-] [-(02)    0205-] [-       0205-( )-


RUNG 0206                        LOCK DRIVE IN REVERSE                F8,G5,E5,H5

!REVERS RECYCL RESET  EMERG.                                              REV.
!E       SEL.  PUSH    STOP                                               LOCK
!BUTTON SWITCH BUTTON #6                                                  CR
! 0035   0035   0035   0171                                               0171
+--] [-+--]/[-+--]/[-+--]/[-+------+------+------+------+------+------+--( )-
!  -14    -01 !  -12    -05                                               -10
!REV.         !
!LOCK         !
!CR           !
! 0171        !
+--] [-+------+      +      +      +      +      +      +      +      +
!  -10

CROSS REFERENCE

I/00171-10     REV.  LOCK  CR
0165-] [-       0178-] [-       0206-] [-       0206-( )-       0210-] [-
```

```
RUNG 0207

!DSV2
! SOLEN
! VALVE
! 0005                                                                 *-TMR--*
+--]/[-+------+------+------+------+------+------+------+------+------+!TIME  !
!  -15                                                                 !      !
!                                                                      !      !
+      +      +      +      +      +      +      +      +      +      +!S0371 !
!                                                                      !      !
!DSV2                                                                  !      !
! SOLEN                                                                !      !
! VALVE                                                                !      !
! 0005                                                                 !      !
+--]/[-+------+------+------+------+------+------+------+------+------+!CLEAR !
!  -15                                                                 !      !
!                                                                      !      !
+      +      +      +      +      +      +      +      +      +      +! .1S  !
!                                                                      !      !
!                                                                      !      !
+      +      +      +      +      +      +      +      +      +      +!      !
!                                                                      !      !
!                                                                      !      !
+      +      +      +      +      +      +      +      +      +      +!= 0060!
!                                                                      !      !
!                                                                      ! 0186 !
+      +      +      +      +      +      +      +      +      +      +!--( )-!
!                                                                      *---05-*

CROSS REFERENCE

I/00186-05
0207TIMER


S0371
0207TIMER
```

```
RUNG 0208                                                                F7,G4,E4,H4

!FILL
!BASKET
! CR
! 0170                                                                  *-TMR--*
+--] [-+------+------+------+------+------+------+------+------+------+!TIME  !
!  -04                                                                  !      !
!                                                                       !      !
+      +      +      +      +      +      +      +      +      +      +!S0377 !
!                                                                       !      !
!SEQ.                                                                   !      !
!RUN                                                                    !      !
!CR                                                                     !      !
! 0170                                                                  !      !
+--] [-+------+------+------+------+------+------+------+------+------+!CLEAR !
!  -01                                                                  !      !
!                                                                       !      !
+      +      +      +      +      +      +      +      +      +      +! .1S  !
!                                                                       !      !
!                                                                       !      !
+      +      +      +      +      +      +      +      +      +      +!      !
!                                                                       !      !
!                                                                       !      !
+      +      +      +      +      +      +      +      +      +      +!= 2000!
!                                                                       !      !
!                                                                       !FILL  !
!                                                                       !BASKET!
!                                                                       ! CR   !
!                                                                       ! 0187 !
+      +      +      +      +      +      +      +      +      +      +!--( )-!
!                                                                       *---01-*
```

CROSS REFERENCE

I/00187-01 FILL BASKET CR
0208TIMER

S0377
0208TIMER

```
RUNG 0209                        REGEN CR TO STOP DILUTION            F8,G5,E5,H5

!REGEN  SEQ.
!BRAKE  RUN     DRIVE                                                   REGEN
! CR    CR      LOCK                                                   CR2
! 0170   0170   0308                                                    0172
+--] [-+--] [-+--]/[-+------+------+------+------+------+------+------+--( )-
!  -05 !  -01     -06                                                   -04
!REGEN !
!CR2   !
! 0172 !
+--] [-+      +      +      +      +      +      +      +      +      +
!  -04

CROSS REFERENCE

I/00172-04     REGEN CR2
0209-] [-        0209-( )-        0210-] [-        0567-] [-
```

```
RUNG 0210                        REVERSE   CONTACT                    F8,G5,E5,H5

!REGEN  DRIVE                                                           REVERS
!CR2    LOCK   SPARE                                                     CR
! 0172   0308   0002                                                     0302
+--] [-+--]/[-+--] [-+------+------+------+------+------+------+------+--( )-
!  -04 !  -06    -02                                                     -02
!REV.  !
!LOCK  !
!CR    !
! 0171 !
+--] [-+      +      +      +      +      +      +      +      +      +
!  -10

CROSS REFERENCE

I/00302-02     REVERS CR
0178-] [-        0210-( )-        0214-] [-        0217-] [-        0220-] [-
```

```
RUNG 0211

!FREQ   FREQ
!>49.5  >25
! 0172   0172                                          *------------------*
+--]/[-+--]/[-+------+------+------+------+------+------+ LET   S0303 = 0390+
!  -06    -07                                          *------------------*
```

```
CROSS REFERENCE

S0303
0023WRITE        0211LET          0225LET          0228LET
```

```
RUNG 0212

!                                                          *------------------*
+------+------+------+------+------+------+------+------+ LET   S0304 = 0010+
!                                                          *------------------*

CROSS REFERENCE

S0304
0023WRITE        0212LET


RUNG 0213                        DRIVE OUTPUT FREQUENCY                F8,G5,E5,H5

!                                                                        FREQ
!                                                                        >1250
!*------------------*                                                    0172
+ IF    S0307 > 1250++------+------+------+------+------+------+------+--( )-
!*------------------*                                                    -01

CROSS REFERENCE

I/O0172-01     FREQ  >1250
0173-] [-        0213-( )-


RUNG 0214                        IN REVERSE CR                         F8,G5,E5,H5

!       SEQ.                                                             IN REV
!       RUN     REVERS
!SPARE  CR       CR                                                       CR
! 0002   0170    0302                                                     0172
+--]/[-+--] [-+--] [-+------+------+------+------+------+------+------+--( )-
!  -01 !  -01     -02                                                    -08
!IN REV!
!      !
!CR    !
! 0172 !
+--] [-+      +      +      +      +      +      +      +      +      +
!  -08

CROSS REFERENCE

I/O0172-08     IN REV       CR
0214-] [-        0214-( )-        0220-] [-        0580-] [-
```

```
RUNG 0215

!JOG     RECYCL
! PUSH    SEL.
!BUTTON SWITCH
! 0035    0035                                                *-----------------*
+--] [-+--]/[-+------+------+------+------+------+------+ LET   S0301 = 6000+
!  -07     -01                                                *-----------------*
```

CROSS REFERENCE

```
S0301
0023WRITE        0169LET          0170LET          0215LET          0567LET
```

```
RUNG 0216                        DECELERATE AND STOP                    F8,G5,E5,H5

!                                                                          DECEL
!DRIVE                                                                     AND
!RUN                                                                       STOP
! 0302                                                                      0302
+--]/[-+------+------+------+------+------+------+------+------+------+--( )-
!  -01                                                                       -04
```

CROSS REFERENCE

```
I/O0302-04     DECEL AND    STOP
0216-( )-
```

```
RUNG 0217                        BELL LIFT CR                           F8,G5,E5,H5

!              SEQ.                                                        BELL
!REVERS        RUN                                                         LIFT
! CR     SPARE  CR                                                         CR
! 0302    0002   0170                                                       0171
+--] [-+--]/[-+--] [-+------+------+------+------+------+------+------+--( )-
!  -02     -01 !  -01                                                        -14
!BELL          !
!LIFT          !
!CR            !
! 0171         !
+--] [-+------+      +      +      +      +      +      +      +      +
!  -14
```

CROSS REFERENCE

```
I/O0171-14     BELL  LIFT  CR
0217-] [-        0217-( )-        0235-] [-(02)
```

```
RUNG 0218                          DRIVE IN REVERSE                        F8,G5,E5,H5

!REV
!AND UP
! TO SP
! 0172                                                                  *-TMR--*
+--] [-+------+------+------+------+------+------+------+------+------+!TIME  !
!  -09                                                                 !      !
!                                                                      !      !
+      +      +      +      +      +      +      +      +      +      +!S0315 !
!                                                                      !      !
!REV                                                                   !      !
!AND UP                                                                !      !
! TO SP                                                                !      !
! 0172                                                                 !      !
+--] [-+------+------+------+------+------+------+------+------+------+!CLEAR !
!  -09                                                                 !      !
!                                                                      !      !
+      +      +      +      +      +      +      +      +      +      +! .1S  !
!                                                                      !      !
!                                                                      !      !
+      +      +      +      +      +      +      +      +      +      +!      !
!                                                                      !      !
!                                                                      !      !
+      +      +      +      +      +      +      +      +      +      +!= 0010!
!                                                                      !      !
!                                                                      !REV   !
!                                                                      !CR    !
!                                                                      ! 0172 !
+      +      +      +      +      +      +      +      +      +      +!--( )-!
!                                                                      *---03-*

CROSS REFERENCE

I/O0172-03     REV   CR
0187-] [-(02)    0218TIMER       0230-] [-


S0315
0218TIMER


RUNG 0219                                                                F8.G5.E5.H5

!REGEN                                                                    LATCH
!BRAKE                                                                    WASH
! CR                                                                      WATER
! 0170                                                                     0171
+--] [-+------+------+------+------+------+------+------+------+------+--(U)-
!  -05 !                                                                   -15
!RESET !
!PUSH  !
!BUTTON!
! 0035 !
+--] [-+      +      +      +      +      +      +      +      +      +
!  -12
```

```
CROSS REFERENCE

I/O0171-15     LATCH WASH  WATER
0219-(U)-


RUNG 0220                        DRIVE IN REVERSE AND TO SPEED        F8,G5,E5,H5

!IN REV         SEQ.                                                    REV
!               RUN     REVERS                                          AND UP
!CR     SPARE   CR       CR                                              TO SP
! 0172   0002   0170    0302                                             0172
+--] [-+--] [-+--] [-+--] [-+------+------+------+------+------+------+--( )-
!  -08    -01 !  -01     -02                                              -09
!REV           !
!AND UP        !
! TO SP        !
! 0172         !
+--] [-+------+      +      +      +      +      +      +      +      +
!  -09

CROSS REFERENCE

I/O0172-09     REV   AND UP TO SP
0218-] [-(02)    0220-] [-       0220-( )-


RUNG 0221                        PLOW OUT CR                          F8,G5,E5,H5

!DSV2   SEQ.                                                            PLOW
! SOLEN RUN                                                             OUT
! VALVE CR                                                              CR
! 0005   0170                                                            0172
+--] [-+--] [-+------+------+------+------+------+------+------+------+--( )-
!  -15 !  -01                                                              -05
!PLOW  !
!OUT   !
!CR    !
! 0172 !
+--] [-+      +      +      +      +      +      +      +      +      +
!  -05

CROSS REFERENCE

I/O0172-05     PLOW  OUT   CR
0221-] [-       0221-( )-
```

```
RUNG 0222                    GATE SOLENOID LOCK IN                F8,G5,E5,H5

!GATE   GATE    EMERG.                                                GATE
! SOLEN SOL      STOP                                                 SOL
! VALVE LOCK    #6                                                    LOCK
! 0005   0172    0171                                                  0171
+--] [-+--]/[-+--]/[-+------+------+------+------+------+------+------+--( )-
!  -12 !  -11     -05                                                   -16
!GATE  !
!SOL   !
!LOCK  !
! 0171 !
+--] [-+      +      +      +      +      +      +      +      +      +
!  -16
```

CROSS REFERENCE

```
I/00171-16     GATE  SOL   LOCK
0222-] [-        0222-( )-        0223-] [-
```

```
RUNG 0223                    GATE SOLENOID LOCK IN                F8,G5,E5,H5

!GATE
!SOL
!LOCK
! 0171                                                            *-TMR--*
+--] [-+------+------+------+------+------+------+------+------+------+!TIME  !
!  -16                                                              !      !
!                                                                   !      !
+      +      +      +      +      +      +      +      +      +      +!S0316 !
!                                                                   !      !
!SEQ.                                                               !      !
!RUN                                                                !      !
!CR                                                                 !      !
! 0170                                                              !      !
+--] [-+------+------+------+------+------+------+------+------+------+!CLEAR !
!  -01                                                              !      !
!                                                                   !      !
+      +      +      +      +      +      +      +      +      +      +! .1S  !
!                                                                   !      !
!                                                                   !      !
+      +      +      +      +      +      +      +      +      +      +!      !
!                                                                   !      !
!                                                                   !      !
+      +      +      +      +      +      +      +      +      +      +!= 0020!
!                                                                   !      !
!                                                                   !GATE  !
!                                                                   !SOL   !
!                                                                   !LOCK  !
!                                                                   ! 0172 !
+      +      +      +      +      +      +      +      +      +      +!--( )-!
!                                                                   *---11-*

CROSS REFERENCE

I/O0172-11     GATE  SOL   LOCK
0222-]/[-        0223TIMER


S0316
0223TIMER
```

```
RUNG 0224                          HOLD GATE OPEN CR                        F8,G5,E5,H5

!RUN     GATE    EMERG. RESET  RECYCL                                          GATE
!PUSH     SOLEN   STOP  PUSH    SEL.                                          HOLD
!BUTTON   VALVE  #6     BUTTON SWITCH                                         OPEN
! 0035    0005    0171   0035   0035                                           0172
+--] [-+--]/[-+--]/[-+--]/[-+--] [-+------+------+------+------+------+--( )-
!  -04 !  -12 !  -05     -12     -01                                            -12
!GATE   !LOAD   !
!HOLD   ! PUSH !
!OPEN   !BUTTON!
! 0172 ! 0035 !
+--] [-+--] [-+      +      +      +      +      +      +      +      +
!  -12     -08

CROSS REFERENCE

I/O0172-12     GATE  HOLD  OPEN
0224-] [-        0224-( )-


RUNG 0225

!FREQ    FREQ
!>49.5   >25
! 0172    0172                                                *------------------*
+--] [-+--] [-+------+------+------+------+------+------+ LET   S0303 = 0280+
!  -06     -07                                                *------------------*

CROSS REFERENCE

S0303
0023WRITE        0211LET          0225LET          0228LET


RUNG 0226                          DRIVE OUTPUT FREQUENCY                   F8,G5,E5,H5

!                                                                            FREQ
!                                                                            >25
!*------------------*                                                        0172
+ IF     S0307 > 2500++------+------+------+------+------+------+------+--( )-
!*------------------*                                                         -07

CROSS REFERENCE

I/O0172-07     FREQ  >25
0211-]/[-        0225-] [-        0226-( )-        0228-] [-
```

```
RUNG 0227                        DRIVE OUTPUT FREQUENCY                F8,G5,E5,H5

!                                                                          FREQ
!                                                                          >49.5
!*------------------*                                                      0172
+ IF    S0307 > 4500++------+------+------+------+------+------+------+--( )-
!*------------------*                                                       -06

CROSS REFERENCE

I/O0172-06    FREQ  >49.5
0211-]/[-       0225-] [-       0227-( )-       0228-]/[-


RUNG 0228

!FREQ   FREQ
!>25    >49.5
! 0172   0172                                          *------------------*
+--] [-+--]/[-+------+------+------+------+------+------+ LET   S0303 = 0490+
!  -07    -06                                          *------------------*

CROSS REFERENCE

S0303
0023WRITE       0211LET         0225LET         0228LET


RUNG 0229                        RESET DRIVE FAIL                      F8,G5,E5,H5

!RESET
!PUSH                                                                      DRIVE
!BUTTON                                                                    RESET
! 0035                                                                      0302
+--] [-+------+------+------+------+------+------+------+------+------+--( )-
!  -12                                                                      -07

CROSS REFERENCE

I/O0302-07    DRIVE RESET
0229-( )-
```

```
RUNG 0230                    RELEASE BELL AFTER CYCLE              F8,G5,E5,H5

!       BELL
!REV     SOLEN                                                        BELL
!CR      VALVE                                                        RELEAS
! 0172   0005                                                         0172
+--] [-+--] [-+------+------+------+------+------+------+------+------+--( )-
!  -03 !  -13                                                          -13
!BELL  !
!RELEAS!
! 0172 !
+--] [-+      +      +      +      +      +      +      +      +      +
!  -13

CROSS REFERENCE

I/O0172-13     BELL  RELEAS
0230-] [-       0230-( )-       0231-] [-(02)
```

```
RUNG 0231                    CYCLE COMPLETE                    F8,G5,E5,H5

!       EMERG.
!BELL   SHUT
!RELEAS OFF
! 0172   0170                                                  *-TMR--*
+--] [-+--]/[-+------+------+------+------+------+------+------+!TIME  !
!  -13    -10                                                  !      !
!                                                              !      !
+      +      +      +      +      +      +      +      +      +!S0380 !
!                                                              !      !
!BELL                                                          !      !
!RELEAS                                                        !      !
! 0172                                                         !      !
+--] [-+------+------+------+------+------+------+------+------+!CLEAR !
!  -13                                                         !      !
!                                                              !      !
+      +      +      +      +      +      +      +      +      +! .1S  !
!                                                              !      !
!                                                              !      !
+      +      +      +      +      +      +      +      +      +!      !
!                                                              !      !
!                                                              !      !
+      +      +      +      +      +      +      +      +      +!= 9999!
!                                                              !      !
!                                                              !CYCLE !
!                                                              !COMPLE!
!                                                              !TE    !
!                                                              ! 0171 !
+      +      +      +      +      +      +      +      +      +!--( )-!
!                                                               *---11-*
```

CROSS REFERENCE

I/00171-11 CYCLE COMPLETE
0231TIMER

S0380
0177IF 0188IF(02) 0189IF(02) 0231TIMER 0233IF(02)

0234IF

```
RUNG 0232                          DRIVE RESET CR                          F8,G5,E5,H5

!RESET  SEQ.   EMERG. EMRGCY STOP
!PUSH   RUN     STOP   STOP  PUSH                                          RESET
!BUTTON CR     #6     BUTTON BUTTON                                        CR
! 0035   0170   0171   0035   0035                                          0172
+--] [-+--]/[-+--] [-+--]/[-+--]/[-+------+------+------+------+------+--( )-
!  -12 !  -01 !  -05 !  -13    -16                                          -02
!      !      !RESET !
!RESET !      !PUSH  !
!CR    !      !BUTTON!
! 0172 !      ! 0035 !
+--] [-+      +--] [-+      +      +      +      +      +      +      +
!  -02           -12

CROSS REFERENCE

I/O0172-02    RESET CR
0177-]/[-       0232-] [-       0232-( )-


RUNG 0233                                                                     F8,G5,E5,H5

!                                        PLOW                                 EMERG.
!                                        IN                                   SHUT
!                                        PRESS                                OFF
!*------------------* *------------------*  0001                            0170
+ IF    S0380 > 0140++ IF    S0380 < 0142++--]/[-+------+------+------+--( )-
!*------------------* *------------------*   -11                             -10

CROSS REFERENCE

I/O0170-10    EMERG.SHUT  OFF
0231-]/[-       0233-( )-


RUNG 0234                                                                     F8,G5,E5,H5

!                                                                             BELL
!                                                                             DROP
!                                                                             TIMER
!*------------------*                                                        0173
+ IF    S0380 > 0220++------+------+------+------+------+------+------+--( )-
!*------------------*                                                         -06

CROSS REFERENCE

I/O0173-06    BELL  DROP  TIMER
0164-]/[-       0178-]/[-       0184-] [-       0234-( )-
```

```
RUNG 0235                                                                F8,G5,E5,H5

!BELL
!LIFT
!CR
! 0171                                                                  *-TMR--*
+--] [-+------+------+------+------+------+------+------+------+------+!TIME  !
!  -14                                                                  !      !
!                                                                       !      !
+      +      +      +      +      +      +      +      +      +      +!S0365 !
!                                                                       !      !
!BELL                                                                   !      !
!LIFT                                                                   !      !
!CR                                                                     !      !
! 0171                                                                  !      !
+--] [-+------+------+------+------+------+------+------+------+------+!CLEAR !
!  -14                                                                  !      !
!                                                                       !      !
+      +      +      +      +      +      +      +      +      +      +! .1S  !
!                                                                       !      !
!                                                                       !      !
+      +      +      +      +      +      +      +      +      +      +!      !
!                                                                       !      !
!                                                                       !      !
+      +      +      +      +      +      +      +      +      +      +!= 0030!
!                                                                       !      !
!                                                                       !BELL  !
!                                                                       !HOLD  !
!                                                                       !TIMER !
!                                                                       ! 0173 !
+      +      +      +      +      +      +      +      +      +      +!--( )-!
!                                                                       *---05-*
```

CROSS REFERENCE

```
I/00173-05     BELL  HOLD  TIMER
0178-] [-        0235TIMER


S0365
0235TIMER
```

```
RUNG 0236                                                                F8,G5,E5,H5

!SEQ.   FILL   WASH                                                        WASH
!RUN    BASKET OUT                                                         OUT
!CR      CR    TIMER                                                       CR
! 0170   0170   0170                                                        0173
+--] [-+--] [-+--]/[-+------+------+------+------+------+------+------+--( )-
!  -01 !  -04 !  -14                                                        -07
!      !LOW   !
!      !SPEED !
!      !CR    !
!      ! 0170 !
+      +--] [-+      +      +      +      +      +      +      +      +
!         -03 !
!SEQ.   WASH  !
!RUN    OUT   !
!CR     LATCH !
! 0170   0173 !
+--]/[-+--]/[-+      +      +      +      +      +      +      +      +
!  -01    -09

CROSS REFERENCE

I/00173-07    WASH  OUT   CR
0199-] [-       0236-( )-       0242-] [-


RUNG 0237                                                                F8,G5,E5,H5

!REGEN                                                                     WASH
!BRAKE                                                                     OUT
! CR                                                                       LATCH
! 0170                                                                     0173
+--] [-+------+------+------+------+------+------+------+------+------+--(L)-
!  -05                                                                      -09

CROSS REFERENCE

I/00173-09    WASH  OUT   LATCH
0236-]/[-       0237-(L)-       0238-(U)-


RUNG 0238                                                                F8,G5,E5,H5

!WASH                                                                      WASH
!SELECT                                                                    OUT
! SWTCH                                                                    LATCH
! 0035                                                                     0173
+--]/[-+------+------+------+------+------+------+------+------+------+--(U)-
!  -10                                                                      -09

CROSS REFERENCE

I/00173-09    WASH  OUT   LATCH
0236-]/[-       0237-(L)-       0238-(U)-
```

```
RUNG 0239                          SEQUENCE LIGHT                          F8,G5,E5,H5

!SEQ
!START                                                                        SEQ
! #5                                                                         LIGHT
! 0268   0171                                                                 0072
+--] [-+--]/[-+------+------+------+------+------+------+------+------+--( )-
!  -05    -02 !                                                                -13
! 0171   8109 !
+--] [-+--] [-+      +      +      +      +      +      +      +      +
!  -02    -01
```

CROSS REFERENCE

```
I/00072-13     SEQ    LIGHT
0239-( )-
```

```
RUNG 0240

!SEQ     SEQ.
!START   RUN
! #5     CR
! 0268    0170                                                                0171
+--] [-+--]/[-+------+------+------+------+------+------+------+------+--( )-
!  -05 !  -01                                                                  -02
! 0171 !
+--] [-+      +      +      +      +      +      +      +      +      +
!  -02
```

CROSS REFERENCE

```
I/00171-02
0239-] [-       0239-]/[-       0240-] [-       0240-( )-
```

```
RUNG 0241                                                                                                F8,G5,E5,H5

!AUTO   SEQ.                                                                                              AUTO
!START  RUN                                                                                               START
!BUTTON CR                                                                                                CR
! 0035   0170                                                                                              0171
+--] [-+--]/[-+------+------+------+------+------+------+------+------+--( )-
!  -05 !  -01                                                                                              -13
!AUTO  !
!START !
!CR    !
! 0171 !
+--] [-+      +      +      +      +      +      +      +      +      +
!  -13
```

CROSS REFERENCE

```
I/00171-13     AUTO  START CR
0164-] [-        0241-] [-        0241-( )-
```

```
RUNG 0242                    LIMITS TIME FOR WASH OUT                F8,G5,E5,H5

!WASH
!OUT
!CR
! 0173                                                              *-TMR--*
+--] [-+------+------+------+------+------+------+------+------+------+!TIME  !
!  -07                                                               !      !
!                                                                    !      !
+      +      +      +      +      +      +      +      -      +      +!S0373 !
!                                                                    !      !
!FILL                                                                !      !
!BASKET                                                              !      !
! CR                                                                 !      !
! 0170                                                               !      !
+--] [-+------+------+------+------+------+------+------+------+------+!CLEAR !
!  -04 !                                                             !      !
!LOW   !                                                             !      !
!SPEED !                                                             !      !
!CR    !                                                             !      !
! 0170 !                                                             !      !
+--] [-+      +      +      +      +      +      +      +      +      +!  .1S !
!  -03                                                               !      !
!                                                                    !      !
+      +      +      +      +      +      +      +      +      +      +!      !
!                                                                    !      !
!                                                                    !      !
+      +      +      +      +      +      +      +      +      +      +!= 9999!
!                                                                    !      !
!                                                                    !WASH  !
!                                                                    !OUT   !
!                                                                    !TIMER !
!                                                                    ! 0170 !
+      +      +      +      +      +      +      +      +      +      +!--( )-!
!                                                                    *---14-*

CROSS REFERENCE

I/00170-14     WASH  OUT   TIMER
0236-]/[-        0242TIMER


S0373
0242TIMER
```

```
RUNG 0578                                                                G1,E1,H1

!BASKET                                                                      LOW
! FULL                                                                       SPEED
!LS                                                                          CR
! 0002                                                                       1170
+--]/[-+------+------+------+------+------+------+------+------+------+--(L)-
!  -16                                                                        -16

CROSS REFERENCE

I/01170-16     LOW   SPEED CR
0537-] [-        0578-(L)-        0579-(U)-
```

```
RUNG 0579                                                                G1,E1,H1

!SEQ.                                                                        LOW
!RUN                                                                         SPEED
!CR                                                                          CR
! 1170                                                                       1170
+--]/[-+------+------+------+------+------+------+------+------+------+--(U)-
!  -01                                                                        -16

CROSS REFERENCE

I/01170-16     LOW   SPEED CR
0537-] [-        0578-(L)-        0579-(U)-
```

```
RUNG 0580

!IN REV
!
!CR
! 0172  *-------------------------*                                          0172
+--] [-+ IF    S0307 >S0361 + 0500++------+------+------+------+------+--( )-
!  -08  *-------------------------*                                           -14

CROSS REFERENCE

I/00172-14
0203-] [-        0580-( )-
```

```
I/00001-01=COOOLING FAN ON    :PLC #1 ONLY
I/00001-02=SPARE              :
I/00001-03=PLOW  IN    PRESS :PLOW IN PRESSURE SWITCH              F9,G6,E6,H6
I/00001-04=ANTI  GIRATE SWITC:ANTI GIRATION SWITCH                 F9,G6,E6,H6
I/00001-05=PLOW  DOWN  LS     :PLOW DOWN LIMIT SWITCH              F9,G6,E6,H6
I/00001-06=SPARE              :
I/00001-07=BELL  DOWN         :BELL DOWN LIMIT SWITCH              F9,G6,E6,H6
I/00001-08=BASKET FULL LS     :BASKET HAS A FULL LOAD OF SUGAR     F9,G6,E6,H6
I/00001-09=F WET SCROLL       :SCROLL UNDER CENTRIFUGALS           PLC #1 ONLY
I/00001-10=SPARE              :
I/00001-11=PLOW  IN    PRESS : PLOW IN PRESSURE SWITCH             F8,G5,E5,H5
I/00001-12=ANTI  GIRATE SWITC:ANTI GIRATION SWITCH                 F8,G5,E5,H5
I/00001-13=PLOW  DOWN  LS     :PLOW DOWN LIMIT SWITCH              F8,G5,E5,H5
I/00001-14=SPARE              :
I/00001-15=BELL  DOWN         :BELL DOWN LIMIT SWITCH              F8,G5,E5,H5
I/00001-16=BASKET FULL LS     :BASKET HAS A FULL LOAD OF SUGAR     F8,G5,E5,H5
I/00002-01=SPARE
I/00002-02=SPARE              :
I/00002-03=PLOW IN PRESS      :PLOW IN PRESSURE SWITCH             F7,G4,E4,H4
I/00002-04=ANTI  GIRATE SWITC:ANTI GIRATION SWITCH                 F7,G4,E4,H4
I/00002-05=PLOW  DOWN  LS     :PLOW DOWN LIMIT SWITCH              F7,G4,E4,H4
I/00002-06=SPARE              :
I/00002-07=BELL  DOWN         :BELL DOWN LIMIT SWITCH              F7,G4,E4,H4
I/00002-08=BASKET FULL LS     :BASKET HAS A FULL LOAD OF SUGAR     F7,G4,E4,H4
I/00002-09=SPARE
I/00002-10=SPARE              :
I/00002-11=PLOW  IN   PRESS   :PLOW IN PRESSURE SWITCH             F6,G3,E3,H3
I/00002-12=ANTI  GIRATE SWITC:ANTI GIRATION SWITCH                 F6,G3,E3,H3
I/00002-13=PLOW  DOWN  LS     :PLOW DOWN LIMIT SWITCH              F6,G3,E3,H3
I/00002-14=SPARE              :
I/00002-15=BELL  DOWN         :BELL DOWN LIMIT SWITCH              F6,G3,E3,H3
I/00002-16=BASKET FULL LS     :BASKET HAS A FULL LOAD OF SUGAR     F6,G3,E3,H3
I/00003-01=SPARE
I/00003-02=F WET SCREW AUX    :PLC #3 ONLY
I/00003-03=PLOW  IN    PRESS :PLOW IN PRESSURE SWITCH              F5,G2,E2,H2
I/00003-04=ANTI  GIRATE SWITC:ANTI GIRATION SWITCH                 F5,G2,E2,H2
I/00003-05=PLOW  DOWN  LS     :PLOW DOWN LIMIT SWITCH              F5,G2,E2,H2
I/00003-06=MOTOR SPEED SWITCH:PROX SWITCH FOR MOTOR SPEED          F5,G2,E2,H2
I/00003-07=BELL  DOWN         :BELL DOWN LIMIT SWITCH              F5,G2,E2,H2
I/00003-08=BASKET FULL LS     :BASKET HAS A FULL LOAD OF SUGAR     F5,G2,E2,H2
I/00003-09=SPARE
I/00003-10=SPARE
I/00003-11=PLOW  IN    PRESS :PLOW IN PRESSURE SWITCH              G1,E1,H1
I/00003-12=ANTI  GIRATE SWITC:ANTI GIRATION SWITCH                 G1,E1,H1
I/00003-13=PLOW  DOWN  LS     :PLOW DOWN LIMIT SWITCH              G1,E1,H1
I/00003-14=MOTOR SPEED SWITCH:PROX SWITCH FOR MOTOR SPEED          G1,E1,H1
I/00003-15=BELL  DOWN         :BELL DOWN LIMIT SWITCH              G1,E1,H1
I/00003-16=BASKET FULL LS     :BASKET HAS A FULL LOAD OF SUGAR     G1,E1,H1
I/00004-01=SPARE
I/00004-02=SPARE
I/00004-03=SPARE
I/00004-04=SPARE
I/00004-05=SPARE
I/00004-06=SPARE
I/00004-07=H WET SCREW        :H WET SCREW AUX CONTACT
I/00004-08=SILENCE BUTTON     :MIXER BLISTER ALARMS PLC 1 ONLY
I/00004-09=MIXER AUX          :E MIXER AUX          PLC 1 ONLY
I/00004-10=BLISTER AUX        :E BLISTER AUX        PLC 1 ONLY
I/00004-11=MIXER   AUX        :F MIXER   AUX        PLC 1 ONLY
```

```
I/O0004-12=BLISTER AUX        :F BLISTER AUX        PLC 1 ONLY
I/O0004-13=MIXER   AUX        :G MIXER   AUX        PLC 1 ONLY
I/O0004-14=BLISTER AUX        :G BLISTER AUX        PLC 1 ONLY
I/O0004-15=MIXER   AUX        :H MIXER   AUX        PLC 1 ONLY
I/O0004-16=BLISTER AUX        :H BLISTER AUX        PLC 1 ONLY
I/O0005-01=GATE   WASH  SV    :GATE   WASH SOLENOID VALVE          F9,G6,E6,H6
I/O0005-02=WASH  WATER SOLEN  :                                    F9,G6,E6,H6
I/O0005-03=BRAKE  SOLEN VALVE:                                     F9,G6,E6,H6
I/O0005-04=GATE   SOLEN VALVE:                                     F9,G6,E6,H6
I/O0005-05=BELL   SOLEN VALVE:                                     F9,G6,E6,H6
I/O0005-06=DSV1   SOLEN VALVE:PLOW UP OR DOWN                      F9,G6,E6,H6
I/O0005-07=DSV2   SOLEN VALVE:PLOW IN OR OUT                       F9,G6,E6,H6
I/O0005-08=SPARE              :                                    F9,G6,E6,H6
I/O0005-09=GATE   WASH  SV    :GATE   WASH SOLENOID VALVE          F8,G5,E5,H5
I/O0005-10=WASH  WATER SOLEN  :                                    F8,G5,E5,H5
I/O0005-11=BRAKE  SOLEN VALVE:                                     F8,G5,E5,H5
I/O0005-12=GATE   SOLEN VALVE:                                     F8,G5,E5,H5
I/O0005-13=BELL   SOLEN VALVE:                                     F8,G5,E5,H5
I/O0005-14=DSV1   SOLEN VALVE:PLOW UP OR DOWN                      F8,G5,E5,H5
I/O0005-15=DSV2   SOLEN VALVE:PLOW IN OR OUT                       F8,G5,E5,H5
I/O0005-16=SPARE              :                                    F7,G4,E4,H4
I/O0006-01=GATE   WASH   SV   :GATE   WASH SOLENOID VALVE          F7,G4,E4,H4
I/O0006-02=WASH  WATER SOLEN  :                                    F7,G4,E4,H4
I/O0006-03=BRAKE  SOLEN VALVE:                                     F7,G4,E4,H4
I/O0006-04=GATE   SOLEN VALVE:                                     F7,G4,E4,H4
I/O0006-05=BELL   SOLEN VALVE:                                     F7,G4,E4,H4
I/O0006-06=DSV1   SOLEN VALVE:PLOW UP OR DOWN                      F7,G4,E4,H4
I/O0006-07=DSV2   SOLEN VALVE:PLOW IN OR OUT                       F7,G4,E4,H4
I/O0006-08=SPARE              :                                    F7,G4,E4,H4
I/O0006-09=GATE   WASH  SV    :GATE   WASH SOLENOID VALVE          F6,G3,E3,H3
I/O0006-10=WASH  WATER SOLEN  :                                    F6,G3,E3,H3
I/O0006-11=BRAKE  SOLEN VALVE:                                     F6,G3,E3,H3
I/O0006-12=GATE   SOLEN VALVE:                                     F6,G3,E3,H3
I/O0006-13=BELL   SOLEN VALVE:                                     F6,G3,E3,H3
I/O0006-14=DSV1   SOLEN VALVE:PLOW UP OR DOWN                      F6,G3,E3,H3
I/O0006-15=DSV2   SOLEN VALVE:PLOW IN OR OUT                       F6,G3,E3,H3
I/O0006-16=SPARE              :                                    F6,G3,E3,H3
I/O0007-01=GATE   WASH  SV    :GATE   WASH SOLENOID VALVE          F5,G2,E2,H2
I/O0007-02=WASH  WATER SOLEN  :                                    F5,G2,E2,H2
I/O0007-03=BRAKE  SOLEN VALVE:                                     F5,G2,E2,H2
I/O0007-04=GATE   SOLEN VALVE:                                     F5,G2,E2,H2
I/O0007-05=BELL   SOLEN VALVE:                                     F5.G2.E2,H2
I/O0007-06=DSV1   SOLEN VALVE:PLOW UP OR DOWN                      F5,G2,E2,H2
I/O0007-07=DSV2   SOLEN VALVE:PLOW IN OR OUT                       F5,G2,E2,H2
I/O0007-08=SPARE              :                                    F5,G2,E2,H2
I/O0007-09=SPIDER WASH  SV    :SPIDER WASH SOLENOID VALVE          G1,E1,H1
I/O0007-10=WASH  WATER SOLEN  :                                    G1,E1,H1
I/O0007-11=BRAKE  SOLEN VALVE:                                     G1,E1,H1
I/O0007-12=GATE   SOLEN VALVE:                                     G1,E1,H1
I/O0007-13=BELL   SOLEN VALVE:                                     G1,E1,H1
I/O0007-14=DSV1   SOLEN VALVE:PLOW UP OR DOWN                      G1,E1,H1
I/O0007-15=DSV2   SOLEN VALVE:PLOW IN OR OUT                       G1,E1,H1
I/O0007-16=F WET SCREW COIL   :PLC #1 ONLY
I/O0008-01=SPARE              :SPARE
I/O0008-02=SPARE              :SPARE
I/O0008-03=SPARE              :SPARE
I/O0008-04=SPARE              :SPARE
I/O0008-05=SPARE              :SPARE
```

```
I/00008-06=SPARE              :SPARE
I/00008-07=SPARE              :SPARE
I/00008-08=SPARE              :SPARE
I/00008-09=ALARM HORN         :PLC1 ONLY
I/00008-10=ALARM LIGHT        :PLC1 ONLY
I/00008-11=SPARE              :SPARE
I/00008-12=SPARE              :SPARE
I/00008-13=SPARE              :SPARE
I/00008-14=SPARE              :SPARE
I/00008-15=SPARE              :SPARE
I/00008-16=SPARE              :SPARE
I/00033-01=RECYCL SEL. SWITCH:RECYCLE SELECTED                        F9,G6,E6,H6
I/00033-02=IN/OUT SEL. SWITCH:IN SELECTED ON THE SELECTOR SWITCH      F9,G6,E6,H6
I/00033-03=VALVE  SEL. SWITCH:UP SELECTED ON THE SELECTOR SWITCH      F9,G6,E6,H6
I/00033-04=RUN   PUSH  BUTTON:                                        F9,G6,E6,H6
I/00033-05=AUTO  START BUTTON:                                        F9,G6,E6,H6
I/00033-06=UP/DWN SEL. SWITCH:                                        F9,G6,E6,H6
I/00033-07=JOG    PUSH BUTTON:                                        F9,G6,E6,H6
I/00033-08=LOAD   PUSH BUTTON:                                        F9,G6,E6,H6
I/00033-09=SPARE  PUSH BUTTON:                                        F9,G6,W6,H6
I/00033-10=WASH  SELECT SWTCH:WASH ON SELECTOR SWITCH                 F9,G6,E6,H6
I/00033-11=OMIT  LOAD  BUTTON:                                        F9,G6,E6,H6
I/00033-12=RESET PUSH  BUTTON:                                        F9,G6,E6,H6
I/00033-13=EMRGCY STOP BUTTON:                                        F9,G6,E6,H6
I/00033-14=REVERSE     BUTTON:                                        F9,G6,E6,H6
I/00033-15=EMRGCY START BUTTO:                                        F9,G6,E6,H6
I/00033-16=STOP  PUSH  BUTTON:                                        F9,G6,E6,H6
I/00035-01=RECYCL SEL. SWITCH:RECYCLE SELECTED                        F8,G5,E5,H5
I/00035-02=IN/OUT SEL. SWITCH:IN SELECTED ON THE SELECTOR SWITCH      F8,G5,E5,H5
I/00035-03=VALVE  SEL. SWITCH:UP SELECTED ON THE SELECTOR SWITCH      F8,G5,E5,H5
I/00035-04=RUN   PUSH  BUTTON:                                        F8,G5,E5,H5
I/00035-05=AUTO  START BUTTON:                                        F8,G5,E5,H5
I/00035-06=UP/DWN SEL. SWITCH:                                        F8,G5,E5,H5
I/00035-07=JOG    PUSH BUTTON:                                        F8,G5,E5,H5
I/00035-08=LOAD   PUSH BUTTON:                                        F8,G5,E5,H5
I/00035-09=SPARE  PUSH BUTTON:                                        F8,G5,E5,H5
I/00035-10=WASH  SELECT SWTCH:WASH ON SELECTOR SWITCH                 F8,G5,E5,H5
I/00035-11=OMIT  LOAD  BUTTON:                                        F8,G5,E5,H5
I/00035-12=RESET PUSH  BUTTON:                                        F8,G5,E5,H5
I/00035-13=EMRGCY STOP BUTTON:                                        F8,G5,E5,H5
I/00035-14=REVERSE     BUTTON:                                        F8,G5,E5,H5
I/00035-15=EMRGCY START BUTTO:                                        F8.G5.E5.H5
I/00035-16=STOP  PUSH  BUTTON:                                        F8,G5,E5,H5
I/00037-01=RECYCL SEL. SWITCH:RECYCLE SELECTED                        F7,G4,E4,H4
I/00037-02=IN/OUT SEL. SWITCH:IN SELECTED ON THE SELECTOR SWITCH      F7,G4,E4,H4
I/00037-03=VALVE  SEL. SWITCH:UP SELECTED ON THE SELECTOR SWITCH      F7,G4,E4,H4
I/00037-04=RUN   PUSH  BUTTON:                                        F7,G4,E4,H4
I/00037-05=AUTO  START BUTTON:                                        F7,G4,E4,H4
I/00037-06=UP/DWN SEL. SWITCH:                                        F7,G4,E4,H4
I/00037-07=JOG    PUSH BUTTON:                                        F7,G4,E4,H4
I/00037-08=LOAD   PUSH BUTTON:                                        F7,G4,E4,H4
I/00037-09=SPARE  PUSH BUTTON:                                        F7,G4,E4,H4
I/00037-10=WASH  SELECT SWTCH:WASH ON SELECTOR SWITCH                 F7,G4,E4,H4
I/00037-11=OMIT  LOAD  BUTTON:                                        F7,G4,E4,H4
I/00037-12=RESET PUSH  BUTTON:                                        F7,G4,E4,H4
I/00037-13=EMRGCY STOP BUTTON:                                        F7,G4,E4,H4
I/00037-14=REVERSE     BUTTON:                                        F7,G4,E4,H4
I/00037-15=EMRGCY START BUTTO:                                        F7,G4,E4,H4
```

```
I/00037-16=STOP  PUSH  BUTTON:                                    F7,G4,E4,H4
I/00039-01=RECYCL SEL. SWITCH:RECYCLE SELECTED                    F6,G3,E3,H3
I/00039-02=IN/OUT SEL. SWITCH:IN SELECTED ON THE SELECTOR SWITCH  F6,G3,E3,H3
I/00039-03=VALVE  SEL. SWITCH:UP SELECTED ON THE SELECTOR SWITCH  F6,G3,E3,H3
I/00039-04=RUN   PUSH  BUTTON:                                    F6,G3,E3,H3
I/00039-05=AUTO  START BUTTON:                                    F6,G3,E3,H3
I/00039-06=UP/DWN SEL. SWITCH:                                    F6,G3,E3,H3
I/00039-07=JOG    PUSH BUTTON:                                    F6,G3,E3,H3
I/00039-08=LOAD   PUSH BUTTON:                                    F6,G3,E3,H3
I/00039-09=SPARE  PUSH BUTTON:                                    F6,G3,E3,H3
I/00039-10=WASH  SELECT SWTCH:WASH ON SELECTOR SWITCH             F6,G3,E3,H3
I/00039-11=OMIT  LOAD  BUTTON:                                    F6,G3,E3,H3
I/00039-12=RESET PUSH  BUTTON:                                    F6,G3,E3,H3
I/00039-13=EMRGCY STOP BUTTON:                                    F6,G3,E3,H3
I/00039-14=REVERSE     BUTTON:                                    F6,G3,E3,H3
I/00039-15=EMRGCY START BUTTO:                                    F6,G3,E3,H3
I/00039-16=STOP  PUSH  BUTTON:                                    F6,G3,E3,H3
I/00041-01=RECYCL SEL. SWITCH:RECYCLE SELECTED                    F5,G2,E2,H2
I/00041-02=IN/OUT SEL. SWITCH:IN SELECTED ON THE SELECTOR SWITCH  F5,G2,E2,H2
I/00041-03=VALVE  SEL. SWITCH:UP SELECTED ON THE SELECTOR SWITCH  F5,G2,E2,H2
I/00041-04=RUN   PUSH  BUTTON:                                    F5,G2,E2,H2
I/00041-05=AUTO  START BUTTON:                                    F5,G2,E2,H2
I/00041-06=UP/DWN SEL. SWITCH:                                    F5,G2,E2,H2
I/00041-07=JOG    PUSH BUTTON:                                    F5,G2,E2,H2
I/00041-08=LOAD   PUSH BUTTON:                                    F5,G2,E2,H2
I/00041-09=SPARE  PUSH BUTTON:                                    F5,G2,E2,H2
I/00041-10=WASH  SELECT SWTCH:WASH ON SELECTOR SWITCH             F5,G2,E2,H2
I/00041-11=OMIT  LOAD  BUTTON:                                    F5,G2,E2,H2
I/00041-12=RESET PUSH  BUTTON:                                    F5,G2,E2,H2
I/00041-13=EMRGCY STOP BUTTON:                                    F5,G2,E2,H2
I/00041-14=REVERSE     BUTTON:                                    F5,G2,E2,H2
I/00041-15=EMRGCY START BUTTO:                                    F5,G2,E2,H2
I/00041-16=STOP  PUSH  BUTTON:                                    F5,G2,E2,H2
I/00043-01=RECYCL SEL. SWITCH:RECYCLE SELECTED                    G1.E1.H1
I/00043-02=IN/OUT SEL. SWITCH:IN SELECTED ON THE SELECTOR SWITCH  G1.E1.H1
I/00043-03=VALVE  SEL. SWITCH:UP SELECTED ON THE SELECTOR SWITCH  G1,E1,H1
I/00043-04=RUN   PUSH  BUTTON:                                    G1,E1,H1
I/00043-05=AUTO  START BUTTON:                                    G1,E1,H1
I/00043-06=UP/DWN SEL. SWITCH:                                    G1,E1,H1
I/00043-07=JOG    PUSH BUTTON:                                    G1,E1,H1
I/00043-08=LOAD   PUSH BUTTON:                                    G1,E1,H1
I/00043-09=SPARE  PUSH BUTTON:                                    G1,E1,H1
I/00043-10=WASH  SELECT SWTCH:WASH ON SELECTOR SWITCH             G1,E1,H1
I/00043-11=OMIT  LOAD  BUTTON:                                    G1,E1,H1
I/00043-12=RESET PUSH  BUTTON:                                    G1,E1,H1
I/00043-13=EMRGCY STOP BUTTON:                                    G1,E1,H1
I/00043-14=REVERSE     BUTTON:                                    G1,E1,H1
I/00043-15=EMRGCY START BUTTO:                                    G1,E1,H1
I/00043-16=STOP  PUSH  BUTTON:                                    G1,E1,H1
I/00071-09=CYCLE LIGHT       :DRIVE FAIL BLINK                    F9,G6,E6,H6
I/00071-13=SEQ   LIGHT       :SEQUENCE LIGHT                      F9,G6,E6,H6
I/00072-09=CYCLE LIGHT       :DRIVE FAIL BLINK                    F8,G5,E5,H5
I/00072-13=SEQ   LIGHT       :SEQUENCE LIGHT                      F8,G5,E5,H5
I/00073-09=CYCLE LIGHT       :DRIVE FAIL BLINK                    F7,G5,E5,H5
I/00073-13=SEQ   LIGHT       :SEQUENCE LIGHT                      F7,G5,E5,H5
I/00074-09=CYCLE LIGHT       :DRIVE FAIL BLINK                    F6,G4,E4,H4
I/00074-13=SEQ   LIGHT       :SEQUENCE LIGHT                      F6,G4,E4,H4
I/00075-09=CYCLE LIGHT       :DRIVE FAIL BLINK                    F5,G3,E3,H3
```

```
I/O0075-13=SEQ    LIGHT        :SEQUENCE LIGHT                          F5,G3,E3,H3
I/O0076-09=CYCLE LIGHT         :DRIVE FAIL BLINK                        F4,G2,E2,H2
I/O0076-13=SEQ    LIGHT        :SEQUENCE LIGHT                          F4,G2,E2,H2
I/O0160-01=SEQ.   RUN    CR    :                                        F9,G6,E6,H6
I/O0160-02=SEQ.   AUTO   CR    :                                        F9,G6,E6,H6
I/O0160-03=LOW    SPEED CR     :                                        F9.G6.E6.H6
I/O0160-04=FILL   BASKET CR    :                                        F9,G6,E6,H6
I/O0160-05=REGEN BRAKE   CR    :                                        F9,G6,E6,H6
I/O0160-06=CYCLE COMPLT CR1    :                                        F9,G6,E6,H6
I/O0160-07=CYCLE COMPLT CR2    :                                        F9,G6,E6,H6
I/O0160-08=WASH   WATER  CR1   :                                        F9,G6,E6,H6
I/O0160-09=WASH   WATER  CR2   :                                        F9,G6,E6,H6
I/O0160-10=HOLD   PLOW         :WET SCROLL OFF DO NOT PLOW OUT          F9,G6,E6,H6
I/O0160-11=EMERG.SHUT   OFF    :                                        F9,G6,E6,H6
I/O0160-12=PLOW   COMPLT    CR :PLOW OUT COMPLETE                       F9,G6,E6,H6
I/O0160-13=JOG          CR     :                                        F9,G6,E6,H6
I/O0160-14=WASH   OUT    TIMER :LIMITS TIME FOR WASH OUT                F9,G6,E6,H6
I/O0160-15=OMIT   LOAD   CR    :                                        F9,G6,E6,H6
I/O0160-16=LOW    SPEED CR     :                                        F9,G6,E6,H6
I/O0161-01=MAN    START #6     :                                        F9,G6,E6,H6
I/O0161-03=STEP   THRU  #6     :                                        F9,G6,E6,H6
I/O0161-04=LATCH HIGH   #6     :                                        F9,G6,E6,H6
I/O0161-05=EMERG. STOP #6      :                                        F9,G6,E6,H6
I/O0161-06=RUN    CR    #6     :                                        F9,G6,E6,H6
I/O0161-09=ZERO   SPEED CR     :                                        F9,G6,E6,H6
I/O0161-10=REV.   LOCK   CR    :LOCK DRIVE IN REVERSE                   F9,G6,E6,H6
I/O0161-11=CYCLE COMPLETE      :CYCLE COMPLETE                          F9,G6,E6,H6
I/O0161-12=BASKET FULL CR      :BASKET FULL                             F9,G6,E6,H6
I/O0161-13=AUTO   START CR     :                                        F9,G6,E6,H6
I/O0161-14=BELL   LIFT   CR    :BELL LIFT CR                            F9,G6,E6,H6
I/O0161-15=LATCH WASH   WATER  :                                        F9,G6,E6,H6
I/O0161-16=GATE   SOL    LOCK  :GATE SOLENOID LOCK IN                   F9,G6,E6,H6
I/O0162-01=FREQ   >1250        :DRIVE OUTPUT FREQUENCY                  F9,G6,E6,H6
I/O0162-02=RESET CR            :DRIVE RESET CR                          F9,G6,E6,H6
I/O0162-03=REV    CR           :DRIVE IN REVERSE                        F9,G6,E6,H6
I/O0162-04=REGEN CR2           :REGEN CR TO STOP DILUTION               F9,G6,E6,H6
I/O0162-05=PLOW   OUT    CR    :PLOW OUT CR                             F9,G6,E6,H6
I/O0162-06=FREQ   >49.5        :DRIVE OUTPUT FREQUENCY                  F9,G6,E6,H6
I/O0162-07=FREQ   >25          :DRIVE OUTPUT FREQUENCY                  F9,G6,E6,H6
I/O0162-08=IN REV       CR     :IN REVERSE CR                           F9,G6,E6,H6
I/O0162-09=REV    AND UP TO SP:DRIVE IN REVERSE AND TO SPEED            F9,G6.E6,H6
I/O0162-11=GATE   SOL    LOCK  :GATE SOLENOID LOCK IN                   F9,G6,E6,H6
I/O0162-12=GATE   HOLD   OPEN  :HOLD GATE OPEN CR                       F9,G6,E6,H6
I/O0162-13=BELL   RELEAS       :RELEASE BELL AFTER CYCLE                F9,G6,E6,H6
I/O0162-15=FREQ   <1380        :DRIVE OUTPUT FREQUENCY                  F9,G6,E6,H6
I/O0163-05=BELL   HOLD   TIMER :                                        F9,G6,E6,H6
I/O0163-06=BELL   DROP   TIMER :                                        F9,G6,E6,H6
I/O0163-07=WASH   OUT    CR    :                                        F9,G6,E6,H6
I/O0163-09=WASH   OUT    LATCH :                                        F9,G6,E6,H6
I/O0170-01=SEQ.   RUN    CR    :                                        F8,G5,E5,H5
I/O0170-02=SEQ.   AUTO   CR    :                                        F8,G5,E5,H5
I/O0170-03=LOW    SPEED CR     :                                        F8,G5,E5,H5
I/O0170-04=FILL   BASKET CR    :                                        F8,G5,E5,H5
I/O0170-05=REGEN BRAKE   CR    :                                        F8,G5,E5,H5
I/O0170-06=CYCLE COMPLT CR1    :                                        F8,G5,E5,H5
I/O0170-07=CYCLE COMPLT CR2    :                                        F8,G5,E5,H5
I/O0170-08=WASH   WATER  CR1   :                                        F8,G5,E5,H5
I/O0170-09=WASH   WATER  CR2   :                                        F8,G5,E5,H5
```

```
I/00170-10=EMERG.SHUT  OFF    :                                    F8,G5,E5,H5
I/00170-12=PLOW  COMPLT   CR :PLOW OUT COMPLETE                    F8,G5,E5,H5
I/00170-13=JOG          CR    :                                    F8,G5,E5,H5
I/00170-14=WASH  OUT   TIMER :LIMITS TIME FOR WASH OUT             F8,G5,E5,H5
I/00170-15=OMIT  LOAD  CR    :                                    F8,G5,E5,H5
I/00170-16=LOW   SPEED CR    :                                    F8,G5,E5,H5
I/00171-01=MAN   START #6    :                                    F8,G5,E5,H5
I/00171-03=STEP  THRU  #6    :                                    F8,G5,E5,H5
I/00171-04=LATCH HIGH  #6    :                                    F8,G5,E5,H5
I/00171-05=EMERG. STOP #6    :                                    F8,G5,E5,H5
I/00171-09=ZERO  SPEED CR    :                                    F8,G5,E5,H5
I/00171-10=REV.  LOCK  CR    :LOCK DRIVE IN REVERSE                F8,G5,E5,H5
I/00171-11=CYCLE COMPLETE    :CYCLE COMPLETE                       F8,G5,E5,H5
I/00171-12=BASKET FULL CR    :BASKET FULL                          F8,G5,E5,H5
I/00171-13=AUTO  START CR    :                                    F8,G5,E5,H5
I/00171-14=BELL  LIFT  CR    :BELL LIFT CR                         F8,G5,E5,H5
I/00171-15=LATCH WASH  WATER :                                    F8.G5.E5.H5
I/00171-16=GATE  SOL   LOCK  :GATE SOLENOID LOCK IN                F8,G5,E5,H5
I/00172-01=FREQ  >1250       :DRIVE OUTPUT FREQUENCY               F8,G5,E5,H5
I/00172-02=RESET CR          :DRIVE RESET CR                       F8,G5,E5,H5
I/00172-03=REV   CR          :DRIVE IN REVERSE                     F8,G5,E5,H5
I/00172-04=REGEN CR2         :REGEN CR TO STOP DILUTION            F8,G5,E5,H5
I/00172-05=PLOW  OUT   CR    :PLOW OUT CR                          F8,G5,E5,H5
I/00172-06=FREQ  >49.5       :DRIVE OUTPUT FREQUENCY               F8,G5,E5,H5
I/00172-07=FREQ  >25         :DRIVE OUTPUT FREQUENCY               F8,G5,E5,H5
I/00172-08=IN REV      CR    :IN REVERSE CR                        F8,G5,E5,H5
I/00172-09=REV   AND UP TO SP:DRIVE IN REVERSE AND TO SPEED        F8,G5,E5,H5
I/00172-11=GATE  SOL   LOCK  :GATE SOLENOID LOCK IN                F8,G5,E5,H5
I/00172-12=GATE  HOLD  OPEN  :HOLD GATE OPEN CR                    F8,G5,E5,H5
I/00172-13=BELL  RELEAS      :RELEASE BELL AFTER CYCLE             F8,G5,E5,H5
I/00172-15=FREQ  <1380       :DRIVE OUTPUT FREQUENCY               F8,G5,E5,H5
I/00173-05=BELL  HOLD  TIMER :                                    F8,G5,E5,H5
I/00173-06=BELL  DROP  TIMER :                                    F8,G5,E5,H5
I/00173-07=WASH  OUT   CR    :                                    F8,G5,E5,H5
I/00173-09=WASH  OUT   LATCH :                                    F8,G5,E5,H5
I/00175-01=CYCLE TIMER       :S250                                 F9,G6,E6,H6
I/00175-02=REGEN TIMER       :S252                                 F9,G6,E6,H6
I/00175-03=PLOW  OUT   TIMER :S253                                 F9,G6,E6,H6
I/00175-04=DILUTION    TIMER :S254                                 F9,G6,E6,H6
I/00175-05=WASH  WATER TIMER1:S255                                 F9,G6,E6,H6
I/00175-06=WASH  WATER TIMER2:S256                                 F9,G6,E6,H6
I/00175-07=WASH  WATER TIMER3:S257                                 F9,G6,E6,H6
I/00175-08=PULSE TIMER #1    :S258                                 F9,G6,E6,H6
I/00175-09=PULSE TIMER #2    :S259                                 F9,G6,E6,H6
I/00175-10=RESET TIMER       :S260                                 F9,G6,E6,H6
I/00175-11=MAN   SPEED TIMER :S261                                 F9,G6,E6,H6
I/00175-12=ZERO  SPEED TIMER1:S262                                 F9,G6,E6,H6
I/00175-13=300   RPM   TIMER1:S263                                 F9,G6,E6,H6
I/00175-14=300   RPM   TIMER2:S264                                 F9,G6,E6,H6
I/00175-15=ZERO  SPEED TIMER1:S265                                 F9,G6,E6,H6
I/00175-16=ZERO  SPEED TIMER3:S266                                 F9,G6,E6,H6
I/00176-01=PLOW  IN    TIMER :PLOW IN TIMER                        F9,G6,E6,H6
I/00176-03=PLOW  COMPLT  TMR :PLOW OUT COMPLETE TIMER              F9,G6,E6,H6
I/00177-01=FILL  BSKT  CR    :BASKET FILL CR                       F9,G6,E6,H6
I/00180-01=SEQ.  RUN   CR    :                                    F7,G4,E4,H4
I/00180-02=SEQ.  AUTO  CR    :                                    F7,G4,E4,H4
I/00180-03=LOW   SPEED CR    :                                    F7,G4,E4,H4
I/00180-04=FILL  BASKET CR   :                                    F7,G4,E4,H4
```

```
I/00180-05=REGEN BRAKE  CR   :                                    F7,G4,E4,H4
I/00180-06=CYCLE COMPLT CR1  :                                    F7,G4,E4,H4
I/00180-07=CYCLE COMPLT CR2  :                                    F7,G4,E4,H4
I/00180-08=WASH  WATER  CR1  :                                    F7,G4,E4,H4
I/00180-09=WASH  WATER  CR2  :                                    F7,G4,E4,H4
I/00180-10=HOLD  PLOW        :WET SCROLL OFF DO NOT PLOW OUT      F7,G4,E4,H4
I/00180-11=EMERG.SHUT  OFF   :                                    F7,G4,E4,H4
I/00180-12=PLOW  COMPLT   CR :PLOW OUT COMPLETE                   F7,G4,E4,H4
I/00180-13=JOG         CR    :                                    F7,G4,E4,H4
I/00180-14=WASH  OUT   TIMER :LIMITS TIME FOR WASH OUT            F7,G4,E4,H4
I/00180-15=OMIT  LOAD  CR    :                                    F7,G4,E4,H4
I/00180-16=LOW   SPEED CR    :                                    F7,G4,E4,H4
I/00181-01=MAN   START #6    :                                    F7,G4,E4,H4
I/00181-03=STEP  THRU  #6    :                                    F7,G4,E4,H4
I/00181-04=LATCH HIGH  #6    :                                    F7.G4.E4.H4
I/00181-05=EMERG. STOP #6    :                                    F7,G4,E4,H4
I/00181-09=ZERO  SPEED CR    :                                    F7,G4,E4,H4
I/00181-10=REV.  LOCK  CR    :LOCK DRIVE IN REVERSE               F7,G4,E4,H4
I/00181-11=CYCLE COMPLETE    :CYCLE COMPLETE                      F7,G4,E4,H4
I/00181-12=BASKET FULL CR    :BASKET FULL                         F7,G4,E4,H4
I/00181-13=AUTO  START CR    :                                    F7,G4,E4,H4
I/00181-14=BELL  LIFT  CR    :BELL LIFT CR                        F7,G4,E4,H4
I/00181-15=LATCH WASH  WATER :                                    F7,G4,E4,H4
I/00181-16=GATE  SOL   LOCK  :GATE SOLENOID LOCK IN               F7,G4,E4,H4
I/00182-01=FREQ  >1250       :DRIVE OUTPUT FREQUENCY              F7,G4,E4,H4
I/00182-02=RESET CR          :DRIVE RESET CR                      F7,G4,E4,H4
I/00182-03=REV   CR          :DRIVE IN REVERSE                    F7,G4,E4,H4
I/00182-04=REGEN CR2         :REGEN CR TO STOP DILUTION           F7,G4,E4,H4
I/00182-05=PLOW  OUT   CR    :PLOW OUT CR                         F7,G4,E4,H4
I/00182-06=FREQ  >49.5       :DRIVE OUTPUT FREQUENCY              F7,G4,E4,H4
I/00182-07=FREQ  >25         :DRIVE OUTPUT FREQUENCY              F7,G4,E4,H4
I/00182-08=IN REV      CR    :IN REVERSE CR                       F7,G4,E4,H4
I/00182-09=REV   AND UP TO SP:DRIVE IN REVERSE AND TO SPEED       F7,G4,E4,H4
I/00182-11=GATE  SOL   LOCK  :GATE SOLENOID LOCK IN               F7,G4,E4,H4
I/00182-12=GATE  HOLD  OPEN  :HOLD GATE OPEN CR                   F7,G4,E4,H4
I/00182-13=BELL  REL   CR    :BELL RELEASE CR                     F7,G4,E4,H4
I/00183-05=BELL  HOLD  TIMER :                                    F7,G4,E4,H4
I/00183-06=BELL  DROP  TIMER :                                    F7,G4,E4,H4
I/00183-07=WASH  OUT   CR    :                                    F7,G4,E4,H4
I/00183-09=WASH  OUT   LATCH :                                    F7,G4,E4,H4
I/00185-01=CYCLE TIMER       :S550                                F8,G5,E5,H5
I/00185-02=REGEN TIMER       :S552                                F8,G5,E5,H5
I/00185-03=PLOW  OUT   TIMER :S553                                F8,G5,E5,H5
I/00185-04=DILUTION    TIMER :S554                                F8,G5,E5,H5
I/00185-05=WASH  WATER TIMER1:S555                                F8,G5,E5,H5
I/00185-06=WASH  WATER TIMER2:S556                                F8,G5,E5,H5
I/00185-07=WASH  WATER TIMER3:S557                                F8,G5,E5,H5
I/00185-08=PULSE TIMER #1    :S558                                F8,G5,E5,H5
I/00185-09=PULSE TIMER #2    :S559                                F8,G5,E5,H5
I/00185-10=RESET TIMER       :S560                                F8,G5,E5,H5
I/00185-11=MAN   SPEED TIMER :S561                                F8,G5,E5,H5
I/00185-12=ZERO  SPEED TIMER1:S562                                F8,G5,E5,H5
I/00185-13=300   RPM   TIMER1:S563                                F8,G5,E5,H5
I/00185-14=300   RPM   TIMER2:S564                                F8,G5,E5,H5
I/00185-15=ZERO  SPEED TIMER1:S565                                F8,G5,E5,H5
I/00185-16=ZERO  SPEED TIMER3:S566                                F8,G5,E5,H5
I/00187-01=FILL  BASKET CR   :                                    F7,G4,E4,H4
I/00190-01=SEQ.  RUN   CR    :                                    F6,G3,E3,H3
```

```
I/00190-02=SEQ.  AUTO  CR    :                                    F6,G3,E3,H3
I/00190-03=LOW   SPEED CR    :                                    F6,G3,E3,H3
I/00190-04=FILL  BASKET CR   :                                    F6,G3,E3,H3
I/00190-05=REGEN BRAKE  CR   :                                    F6,G3,E3,H3
I/00190-06=CYCLE COMPLT CR1  :                                    F6,G3,E3,H3
I/00190-07=CYCLE COMPLT CR2  :                                    F6,G3,E3,H3
I/00190-08=WASH  WATER  CR1  :                                    F6,G3,E3,H3
I/00190-09=WASH  WATER  CR2  :                                    F6,G3,E3,H3
I/00190-10=HOLD  PLOW        :WET SCROLL OFF DO NOT PLOW OUT      F6,G3,E3,H3
I/00190-11=EMERG.SHUT  OFF   :                                    F6,G3,E3,H3
I/00190-12=PLOW  COMPLT   CR :PLOW OUT COMPLETE                   F6,G3,E3,H3
I/00190-13=JOG         CR    :                                    F6,G3,E3,H3
I/00190-14=WASH  OUT   TIMER :LIMITS TIME FOR WASH OUT            F6,G3,E3,H3
I/00190-15=OMIT  LOAD  CR    :                                    F6,G3,E3,H3
I/00190-16=LOW   SPEED CR    :                                    F6,G3,E3,H3
I/00191-01=MAN   START       :                                    F6,G3,E3,H3
I/00191-03=STEP  THRU        :                                    F6,G3,E3,H3
I/00191-04=LATCH HIGH        :                                    F6,G3,E3,H3
I/00191-05=EMERG. STOP       :                                    F6,G3,E3,H3
I/00191-06=RUN   CR          :                                    F6,G3,E3,H3
I/00191-07=SEQ.  INS.  CR1   :SEQUENCE INSURANCE                  F6,G3,E3,H3
I/00191-08=SEQ.  INS.  CR2   :SEQUENCE INSURANCE                  F6,G3,E3,H3
I/00191-09=ZERO  SPEED CR    :                                    F6,G3,E3,H3
I/00191-10=REV.  LOCK  CR    :LOCK DRIVE IN REVERSE               F6,G3,E3,H3
I/00191-11=CYCLE COMPLETE    :CYCLE COMPLETE                      F6,G3,E3,H3
I/00191-12=BASKET FULL CR    :BASKET FULL                         F6,G3,E3,H3
I/00191-13=AUTO  START CR    :                                    F6,G3,E3,H3
I/00191-14=BELL  LIFT  CR    :BELL LIFT CR                        F6,G3,E3,H3
I/00191-15=LATCH WASH  WATER :                                    F6,G3,E3,H3
I/00191-16=GATE  SOL   LOCK  :GATE SOLENOID LOCK IN               F6,G3,E3,H3
I/00192-01=FREQ  >1250       :DRIVE OUTPUT FREQUENCY              F6,G3,E3,H3
I/00192-02=RESET CR          :DRIVE RESET CR                      F6,G3,E3,H3
I/00192-03=REV   CR          :DRIVE IN REVERSE                    F6,G3,E3,H3
I/00192-04=REGEN CR2         :REGEN CR TO STOP DILUTION           F6,G3,E3,H3
I/00192-05=PLOW  OUT   CR    :PLOW OUT CR                         F6,G3,E3,H3
I/00192-06=FREQ  >49.5       :DRIVE OUTPUT FREQUENCY              F6,G3,E3,H3
I/00192-07=FREQ  >25         :DRIVE OUTPUT FREQUENCY              F6,G3,E3,H3
I/00192-08=IN REV      CR    :IN REVERSE CR                       F6,G3,E3,H3
I/00192-09=REV   AND UP TO SP:DRIVE IN REVERSE AND TO SPEED       F6,G3,E3,H3
I/00192-11=GATE  SOL   LOCK  :GATE SOLENOID LOCK IN               F6,G3,E3,H3
I/00192-12=GATE  HOLD  OPEN  :HOLD GATE OPEN CR                   F6,G3,E3,H3
I/00192-13=BELL  RELEAS      :RELEASE BELL AFTER CYCLE            F6,G3,E3,H3
I/00192-15=FREQ  <1380       :DRIVE OUTPUT FREQUENCY              F6,G3,E3,H3
I/00193-01=SCRL  SPEED TMR #1:                                    F6,G3,E3,H3
I/00193-02=SCRL  SPEED TMR #3:                                    F6,G3,E3,H3
I/00193-03=SCRL  SPEED TMR #2:                                    F6,G3,E3,H3
I/00193-04=SCRL  SPEED TMR #4:                                    F6,G3,E3,H3
I/00193-05=BELL  HOLD  TIMER :                                    F6,G3,E3,H3
I/00193-06=BELL  DROP  TIMER :                                    F6,G3,E3,H3
I/00193-07=WASH  OUT   CR    :                                    F6,G3,E3,H3
I/00193-09=WASH  OUT   LATCH :                                    F6,G3,E3,H3
I/00195-01=CYCLE TIMER       :S450                                F7,G4,E4,H4
I/00195-02=REGEN TIMER       :S452                                F7,G4,E4,H4
I/00195-03=PLOW  OUT   TIMER :S453                                F7,G4,E4,H4
I/00195-04=DILUTION    TIMER :S454                                F7,G4,E4,H4
I/00195-05=WASH  WATER TIMER1:S455                                F7,G4,E4,H4
I/00195-06=WASH  WATER TIMER2:S456                                F7,G4,E4,H4
I/00195-07=WASH  WATER TIMER3:S457                                F7,G4,E4,H4
```

```
I/00195-08=PULSE TIMER #1     :S458                                  F7,G4,E4,H4
I/00195-09=PULSE TIMER #2     :S459                                  F7,G4,E4,H4
I/00195-10=RESET TIMER        :S460                                  F7,G4,E4,H4
I/00195-11=MAN   SPEED TIMER  :S461                                  F7,G4,E4,H4
I/00195-12=ZERO  SPEED TIMER1:S462                                   F7,G4,E4,H4
I/00195-13=300   RPM   TIMER1:S463                                   F7,G4,E4,H4
I/00195-14=300   RPM   TIMER2:S464                                   F7,G4,E4,H4
I/00195-15=ZERO  SPEED TIMER1:S465                                   F7,G4,E4,H4
I/00195-16=ZERO  SPEED TIMER3:S466                                   F7,G4,E4,H4
I/00196-03=PLOW  COMPLT TIMER:                                       F7,G4,E4,H4
I/00197-01=FILL  BASKET CR    :                                      F7,G4,E4,H4
I/00200-02=COMM  CR           :COMMUNICATION CR                      F9,G6,E6,H6
I/00200-03=COMM  CR           :COMMUNICATION CR                      F9,G6,E6,H6
I/00200-04=COMM  CR           :COMMUNICATION CR                      F9,G6,E6,H6
I/00200-05=COMM  CR           :COMMUNICATION CR                      F9,G6,E6,H6
I/00200-07=COMM  CR           :COMMUNICATION CR                      F9,G6,E6,H6
I/00200-08=COMM  CR           :COMMUNICATION CR                      F9,G6,E6,H6
I/00202-01=DRIVE RUN          :DRIVE RUN CONTACT                     F9,G6,E6,H6
I/00202-02=REVERS CR          :REVERSE   CONTACT                     F9,G6,E6,H6
I/00202-04=DECEL AND   STOP   :DECELERATE AND STOP                   F9,G6,E6,H6
I/00202-07=DRIVE RESET        :RESET DRIVE FAIL                      F9,G6,E6,H6
I/00208-06=DRIVE LOCK         :      DRIVE FAIL                      F9,G6,E6,H6
I/00268-01=SEQ   START  #1    :START H1 MACHINE
I/00268-02=SEQ   START  #2    :START H2 MACHINE
I/00268-03=SEQ   START  #3    :START H3 MACHINE
I/00268-04=SEQ   START  #4    :START H4 MACHINE
I/00268-05=SEQ   START  #5    :START F5 MACHINE
I/00268-06=SEQ   START  #6    :START F6 MACHINE
I/00268-07=SEQ   START  #7    :START F7 MACHINE
I/00268-08=SEQ   START  #8    :START F8 MACHINE
I/00268-09=SEQ   START  #9    :START F9 MACHINE
I/00268-10=SEQ   START  #10   :START H5 MACHINE
I/00268-11=SEQ   START  #11   :START H6 MACHINE
I/00275-01=CYCLE TIMER        :S550                                  F6,G3,E3,H3
I/00275-02=REGEN TIMER        :S552                                  F6,G3,E3,H3
I/00275-03=PLOW  OUT   TIMER :S553                                   F6,G3,E3,H3
I/00275-04=DILUTION    TIMER :S554                                   F6,G3,E3,H3
I/00275-05=WASH  WATER TIMER1:S555                                   F6,G3,E3,H3
I/00275-06=WASH  WATER TIMER2:S556                                   F6,G3,E3,H3
I/00275-07=WASH  WATER TIMER3:S557                                   F6,G3,E3,H3
I/00275-08=PULSE TIMER #1     :S558                                  F6,G3,E3,H3
I/00275-09=PULSE TIMER #2     :S559                                  F6,G3,E3,H3
I/00275-10=RESET TIMER        :S560                                  F6,G3,E3,H3
I/00275-11=MAN   SPEED TIMER  :S561                                  F6,G3,E3,H3
I/00275-12=ZERO  SPEED TIMER1:S562                                   F6,G3,E3,H3
I/00275-13=300   RPM   TIMER1:S563                                   F6,G3,E3,H3
I/00275-14=300   RPM   TIMER2:S564                                   F6,G3,E3,H3
I/00275-15=ZERO  SPEED TIMER1:S565                                   F6,G3,E3,H3
I/00275-16=ZERO  SPEED TIMER3:S566                                   F6,G3,E3,H3
I/00276-01=PLOW  IN    TIMER :PLOW IN TIMER                          F6,G3,E3,H3
I/00276-03=PLOW  COMPLT  TMR :PLOW OUT COMPLETE TIMER                F6,G3,E3,H3
I/00276-05=PLOW  IN    TIMER :PLOW IN TIMER                          F6,G3,E3,H3
I/00276-06=PLOW  DWN   TIMER :PLOW DOWN TIMER                        F6,G3,E3,H3
I/00277-01=FILL  BSKT  CR    :BASKET FILL CR                         F6,G3,E3,H3
I/00278-01=PLOW  IN      TMR :PLOW IN            TIMER               F6,G3,E3,H3
I/00278-03=PLOW  COMPLT  TMR :PLOW COMPLETE      TIMER               F6,G3,E3,H3
I/00302-01=DRIVE RUN          :DRIVE RUN CONTACT                     F8,G5,E5,H5
I/00302-02=REVERS CR          :REVERSE   CONTACT                     F8,G5,E5,H5
```

```
I/00302-04=DECEL AND   STOP  :DECELERATE AND STOP                F8,G5,E5,H5
I/00302-07=DRIVE RESET       :RESET DRIVE FAIL                   F8,G5,E5,H5
I/00308-06=DRIVE LOCK        :      DRIVE FAIL                   F8,G5,E5,H5
I/00310-01=SPARE             :
I/00310-02=SPARE             :
I/00310-04=SPARE             :
I/00310-05=SPARE             :
I/00310-07=SPARE             :
I/00310-08=SPARE             :
I/00402-01=DRIVE RUN         :DRIVE RUN CONTACT                  F7,G4,E4,H4
I/00402-02=REVERS CR         :REVERSE   CONTACT                  F7,G4,E4,H4
I/00402-04=DECEL AND   STOP  :DECELERATE AND STOP                F7,G4,E4,H4
I/00402-07=DRIVE RESET       :RESET DRIVE FAIL                   F7,G4,E4,H4
I/00408-06=DRIVE LOCK        :      DRIVE FAIL                   F7,G4,E4,H4
I/00500-02=COMM  CR          :COMMUNICATION CR                   F9,G6,E6,H6
I/00500-03=COMM  CR          :COMMUNICATION CR                   F9,G6,E6,H6
I/00500-04=COMM  CR          :COMMUNICATION CR                   F9,G6,E6,H6
I/00500-05=COMM  CR          :COMMUNICATION CR                   F9,G6,E6,H6
I/00500-07=COMM  CR          :COMMUNICATION CR                   F9,G6,E6,H6
I/00500-08=COMM  CR          :COMMUNICATION CR                   F9,G6,E6,H6
I/00502-01=DRIVE RUN         :DRIVE RUN CONTACT                  F9,G6,E6,H6
I/00502-02=REVERS CR         :REVERSE   CONTACT                  F9,G6,E6,H6
I/00502-04=DECEL AND   STOP  :DECELERATE AND STOP                F9,G6,E6,H6
I/00502-07=DRIVE RESET       :RESET DRIVE FAIL                   F9,G6,E6,H6
I/00508-06=DRIVE LOCK        :      DRIVE FAIL                   F9,G6,E6,H6
I/00602-01=DRIVE RUN         :DRIVE RUN CONTACT                  F5,G2,E2,H2
I/00602-02=REVERS CR         :REVERSE   CONTACT                  F5,G2,E2,H2
I/00602-04=DECEL AND   STOP  :DECELERATE AND STOP                F5,G2,E2,H2
I/00602-07=DRIVE RESET       :RESET DRIVE FAIL                   F5,G2,E2,H2
I/00608-06=DRIVE LOCK        :      DRIVE FAIL                   F5,G2,E2,H2
I/00702-01=DRIVE RUN         :DRIVE RUN CONTACT                  G1,E1,H1
I/00702-02=REVERS CR         :REVERSE   CONTACT                  G1,E1,H1
I/00702-04=DECEL AND   STOP  :DECELERATE AND STOP                G1,E1,H1
I/00702-07=DRIVE RESET       :RESET DRIVE FAIL                   G1,E1,H1
I/00708-06=DRIVE LOCK        :      DRIVE FAIL                   G1,E1,H1
I/01160-01=SEQ.  RUN   CR    :                                   F5,G2,E2,H2
I/01160-02=SEQ.  AUTO  CR    :                                   F5,G2,E2,H2
I/01160-03=LOW   SPEED CR    :                                   F5,G2,E2,H2
I/01160-04=FILL  BASKET CR   :                                   F5,G2,E2,H2
I/01160-05=REGEN BRAKE  CR   :                                   F5,G2,E2,H2
I/01160-06=CYCLE COMPLT CR1  :                                   F5,G2,E2,H2
I/01160-07=CYCLE COMPLT CR2  :                                   F5,G2,E2,H2
I/01160-08=WASH  WATER  CR1  :                                   F5,G2,E2,H2
I/01160-09=WASH  WATER  CR2  :                                   F5,G2,E2,H2
I/01160-10=HOLD  PLOW        :WET SCROLL OFF DO NOT PLOW OUT     F5,G2,E2,H2
I/01160-11=EMERG.SHUT  OFF   :                                   F5,G2,E2,H2
I/01160-12=PLOW  COMPLT   CR :PLOW OUT COMPLETE                  F5,G2,E2,H2
I/01160-13=JOG         CR    :                                   F5,G2,E2,H2
I/01160-14=WASH  OUT   TIMER :LIMITS TIME FOR WASH OUT           F5,G2,E2,H2
I/01160-15=OMIT  LOAD  CR    :                                   F5,G2,E2,H2
I/01160-16=LOW   SPEED CR    :                                   F5,G2,E2,H2
I/01161-01=MAN   START       :                                   F5,G2,E2,H2
I/01161-03=STEP  THRU        :                                   F5,G2,E2,H2
I/01161-04=LATCH HIGH        :                                   F5,G2,E2,H2
I/01161-05=EMERG. STOP       :                                   F5,G2,E2,H2
I/01161-06=RUN   CR          :                                   F5,G2,E2,H2
I/01161-07=SEQ.  INS.  CR1   :SEQUENCE INSURANCE                 F5,G2,E2,H2
I/01161-08=SEQ.  INS.  CR2   :SEQUENCE INSURANCE                 F5,G2,E2,H2
```

```
I/01161-09=ZERO  SPEED CR     :                                    F5,G2,E2,H2
I/01161-10=REV.  LOCK  CR     :LOCK DRIVE IN REVERSE               F5,G2,E2,H2
I/01161-11=CYCLE COMPLETE     :CYCLE COMPLETE                      F5,G2,E2,H2
I/01161-12=BASKET FULL CR     :BASKET FULL                         F5,G2,E2,H2
I/01161-13=AUTO  START CR     :                                    F5,G2,E2,H2
I/01161-14=BELL  LIFT  CR     :BELL LIFT CR                        F5,G2,E2,H2
I/01161-15=LATCH WASH  WATER  :                                    F5,G2,E2,H2
I/01161-16=GATE  SOL   LOCK   :GATE SOLENOID LOCK IN               F5,G2,E2,H2
I/01162-01=FREQ  >1250        :DRIVE OUTPUT FREQUENCY              F5,G2,E2,H2
I/01162-02=RESET CR           :DRIVE RESET CR                      F5,G2,E2,H2
I/01162-03=REV   CR           :DRIVE IN REVERSE                    F5,G2,E2,H2
I/01162-04=REGEN CR2          :REGEN CR TO STOP DILUTION           F5,G2,E2,H2
I/01162-05=PLOW  OUT   CR     :PLOW OUT CR                         F5,G2,E2,H2
I/01162-06=FREQ  >49.5        :DRIVE OUTPUT FREQUENCY              F5,G2,E2,H2
I/01162-07=FREQ  >25          :DRIVE OUTPUT FREQUENCY              F5,G2,E2,H2
I/01162-08=IN REV      CR     :IN REVERSE CR                       F5,G2,E2,H2
I/01162-09=REV   AND UP TO SP:DRIVE IN REVERSE AND TO SPEED        F5,G2,E2,H2
I/01162-10=AT    LOAD  SPEED :DRIVE AT LOADING SPEED               F5,G2,E2,H2
I/01162-11=GATE  SOL   LOCK   :GATE SOLENOID LOCK IN               F5,G2,E2,H2
I/01162-12=GATE  HOLD  OPEN   :HOLD GATE OPEN CR                   G1,E1,H1
I/01162-13=BELL  RELEAS       :RELEASE BELL AFTER CYCLE            F5,G2,E2,H2
I/01162-15=FREQ  <1380        :DRIVE OUTPUT FREQUENCY              F5,G2,E2,H2
I/01163-01=SCRL  SPEED TMR #1:                                     F5,G2,E2,H2
I/01163-02=SCRL  SPEED TMR #3:                                     F5,G2,E2,H2
I/01163-03=SCRL  SPEED TMR #2:                                     F5,G2,E2,H2
I/01163-04=SCRL  SPEED TMR #4:                                     F5,G2,E2,H2
I/01163-05=BELL  HOLD  TIMER  :                                    F5,G2,E2,H2
I/01163-06=BELL  DROP  TIMER  :                                    F5,G2,E2,H2
I/01163-07=WASH  OUT   CR     :                                    F5.G2.E2.H2
I/01163-09=WASH  OUT   LATCH  :                                    F5,G2,E2,H2
I/01170-01=SEQ.  RUN   CR     :                                    G1,E1,H1
I/01170-02=SEQ.  AUTO  CR     :                                    G1,E1,H1
I/01170-03=LOW   SPEED CR     :                                    G1,E1,H1
I/01170-04=FILL  BASKET CR    :                                    G1,E1,H1
I/01170-05=REGEN BRAKE  CR    :                                    G1,E1,H1
I/01170-06=CYCLE COMPLT CR1   :                                    G1,E1,H1
I/01170-07=CYCLE COMPLT CR2   :                                    G1,E1,H1
I/01170-08=WASH  WATER  CR1   :                                    G1,E1,H1
I/01170-09=WASH  WATER  CR2   :                                    G1,E1,H1
I/01170-10=HOLD  PLOW         :WET SCROLL OFF DO NOT PLOW OUT      G1,E1,H1
I/01170-11=EMERG.SHUT  OFF    :                                    G1,E1,H1
I/01170-12=PLOW  COMPLT   CR :PLOW OUT COMPLETE                    G1,E1,H1
I/01170-13=JOG         CR     :                                    G1,E1,H1
I/01170-14=WASH  OUT   TIMER :LIMITS TIME FOR WASH OUT             G1,E1,H1
I/01170-15=OMIT  LOAD  CR     :                                    G1,E1,H1
I/01170-16=LOW   SPEED CR     :                                    G1,E1,H1
I/01171-01=MAN   START        :                                    G1,E1,H1
I/01171-03=STEP  THRU         :                                    G1,E1,H1
I/01171-04=LATCH HIGH         :                                    G1,E1,H1
I/01171-05=EMERG. STOP        :                                    G1,E1,H1
I/01171-06=RUN   CR           :                                    G1,E1,H1
I/01171-07=SEQ.  INS.  CR1    :SEQUENCE INSURANCE                  G1,E1,H1
I/01171-08=SEQ.  INS.  CR2    :SEQUENCE INSURANCE                  G1,E1,H1
I/01171-09=ZERO  SPEED CR     :                                    G1,E1,H1
I/01171-10=REV.  LOCK  CR     :LOCK DRIVE IN REVERSE               G1,E1,H1
I/01171-11=CYCLE COMPLETE     :CYCLE COMPLETE                      G1,E1,H1
I/01171-12=BASKET FULL CR     :BASKET FULL                         G1,E1,H1
I/01171-13=AUTO  START CR     :                                    G1,E1,H1
```

```
I/O1171-14=BELL  LIFT  CR    :BELL LIFT CR                          G1,E1,H1
I/O1171-15=LATCH WASH  WATER :                                      G1,E1,H1
I/O1171-16=GATE  SOL   LOCK  :GATE SOLENOID LOCK IN                 G1,E1,H1
I/O1172-01=FREQ  >1250       :DRIVE OUTPUT FREQUENCY                G1,E1,H1
I/O1172-02=RESET CR          :DRIVE RESET CR                        G1,E1,H1
I/O1172-03=REV   CR          :DRIVE IN REVERSE                      G1,E1,H1
I/O1172-04=REGEN CR2         :REGEN CR TO STOP DILUTION             G1,E1,H1
I/O1172-05=PLOW  OUT   CR    :PLOW OUT CR                           G1,E1,H1
I/O1172-06=FREQ  >49.5       :DRIVE OUTPUT FREQUENCY                G1,E1,H1
I/O1172-07=FREQ  >25         :DRIVE OUTPUT FREQUENCY                G1,E1,H1
I/O1172-08=IN REV      CR    :IN REVERSE CR                         G1,E1,H1
I/O1172-09=REV   AND UP TO SP:DRIVE IN REVERSE AND TO SPEED         G1,E1,H1
I/O1172-10=AT    LOAD  SPEED :DRIVE AT LOADING SPEED                G1,E1,H1
I/O1172-11=GATE  SOL   LOCK  :GATE SOLENOID LOCK IN                 G1,E1,H1
I/O1172-12=GATE  HOLD  OPEN  :HOLD GATE OPEN CR                     G1,E1,H1
I/O1172-13=BELL  RELEAS      :RELEASE BELL AFTER CYCLE              G1,E1,H1
I/O1172-15=FREQ  <1380       :DRIVE OUTPUT FREQUENCY                G1,E1,H1
I/O1173-01=SCRL  SPEED TMR #1:                                      G1,E1,H1
I/O1173-02=SCRL  SPEED TMR #3:                                      G1,E1,H1
I/O1173-03=SCRL  SPEED TMR #2:                                      G1,E1,H1
I/O1173-04=SCRL  SPEED TMR #4:                                      G1,E1,H1
I/O1173-05=BELL  HOLD  TIMER :                                      G1,E1,H1
I/O1173-06=BELL  DROP  TIMER :                                      G1,E1,H1
I/O1173-07=WASH  OUT   CR    :                                      G1.E1.H1
I/O1173-09=WASH  OUT   LATCH :                                      G1,E1,H1
I/O1175-01=CYCLE TIMER       :S250                                  F5,G2,E2,H2
I/O1175-02=REGEN TIMER       :S252                                  F5,G2,E2,H2
I/O1175-03=PLOW  OUT   TIMER :S253                                  F5,G2,E2,H2
I/O1175-04=DILUTION    TIMER :S254                                  F5,G2,E2,H2
I/O1175-05=WASH  WATER TIMER1:S255                                  F5,G2,E2,H2
I/O1175-06=WASH  WATER TIMER2:S256                                  F5,G2,E2,H2
I/O1175-07=WASH  WATER TIMER3:S257                                  F5,G2,E2,H2
I/O1175-08=PULSE TIMER #1    :S258                                  F5,G2,E2,H2
I/O1175-09=PULSE TIMER #2    :S259                                  F5,G2,E2,H2
I/O1175-10=RESET TIMER       :S260                                  F5,G2,E2,H2
I/O1175-11=MAN   SPEED TIMER :S261                                  F5,G2,E2,H2
I/O1175-12=ZERO  SPEED TIMER1:S262                                  F5,G2,E2,H2
I/O1175-13=300   RPM   TIMER1:S263                                  F5,G2,E2,H2
I/O1175-14=300   RPM   TIMER2:S264                                  F5,G2,E2,H2
I/O1175-15=ZERO  SPEED TIMER1:S265                                  F5,G2,E2,H2
I/O1175-16=ZERO  SPEED TIMER3:S266                                  F5,G2,E2,H2
I/O1176-01=PLOW  IN    TIMER :PLOW IN TIMER                        F5,G2,E2,H2
I/O1176-03=PLOW  COMPLT  TMR :PLOW OUT COMPLETE TIMER               F5,G2,E2,H2
I/O1176-05=PLOW  IN    TIMER :PLOW IN TIMER                        F5,G2,E2,H2
I/O1176-07=FILL  BSKT  CR    :BASKET FILL CR                        F5,G2,E2,H2
I/O1177-01=FILL  BSKT  CR    :BASKET FILL CR                        F5,G2,E2,H2
I/O1185-01=CYCLE TIMER       :S250                                  G2,E2,H2
I/O1185-02=REGEN TIMER       :S252                                  G2,E2,H2
I/O1185-03=PLOW  OUT   TIMER :S253                                  G2,E2,H2
I/O1185-04=DILUTION    TIMER :S254                                  G2,E2,H2
I/O1185-05=WASH  WATER TIMER1:S255                                  G2,E2,H2
I/O1185-06=WASH  WATER TIMER2:S256                                  G2,E2,H2
I/O1185-07=WASH  WATER TIMER3:S257                                  G2,E2,H2
I/O1185-08=PULSE TIMER #1    :S258                                  G2,E2,H2
I/O1185-09=PULSE TIMER #2    :S259                                  G2,E2,H2
I/O1185-10=RESET TIMER       :S260                                  G2,E2,H2
I/O1185-11=MAN   SPEED TIMER :S261                                  G2,E2,H2
I/O1185-12=ZERO  SPEED TIMER1:S262                                  G2,E2,H2
```

```
I/01185-13=300   RPM    TIMER1:S263                                  G2,E2,H2
I/01185-14=300   RPM    TIMER2:S264                                  G2,E2,H2
I/01185-15=ZERO  SPEED  TIMER1:S265                                  G2,E2,H2
I/01185-16=ZERO  SPEED  TIMER3:S266                                  G2,E2,H2
I/01186-01=PLOW  IN     TIMER :PLOW IN TIMER                         G2,E2,H2
I/01186-03=PLOW  COMPLT  TMR  :PLOW OUT COMPLETE TIMER               G2,E2,H2
I/01186-05=PLOW  IN     TIMER :PLOW IN TIMER                         G2,E2,H2
I/01186-07=FILL  BSKT   CR    :BASKET FILL CR                        G6,E6,H6
I/01187-01=FILL  BSKT   CR    :BASKET FILL CR                        G2,E2,H2
I/01500-01=SILENC CR          :PLC #1 ONLY
I/01500-02=SILENC CR          :PLC #1 ONLY
I/01500-03=SILENC CR          :PLC #1 ONLY
I/01500-04=SILENC CR          :PLC #1 ONLY
I/01500-05=SILENC CR          :PLC #1 ONLY
I/01500-06=SILENC CR          :PLC #1 ONLY
I/01500-07=SILENC CR          :PLC #1 ONLY
I/01500-08=SILENC CR          :PLC #1 ONLY
I/01500-09=ALARM  CR          :PLC #1 ONLY
I/01500-10=ALARM  CR          :PLC #1 ONLY
I/01500-11=ALARM  CR          :PLC #1 ONLY
I/01500-12=ALARM  CR          :PLC #1 ONLY
I/03011-01=COMM               :STATUS FOR DRIVE COMMUNICATIONS
I/03011-16=COMM               :STATUS FOR DRIVE COMMUNICATIONS
I/03011-17=COMM               :STATUS FOR DRIVE COMMUNICATIONS
I/03011-23=COMM               :STATUS FOR DRIVE COMMUNICATIONS
I/03012-01=COMM               :STATUS FOR DRIVE COMMUNICATIONS
I/03012-16=COMM               :STATUS FOR DRIVE COMMUNICATIONS
I/03012-17=COMM               :STATUS FOR DRIVE COMMUNICATIONS
I/03012-23=COMM               :STATUS FOR DRIVE COMMUNICATIONS
I/03013-01=COMM               :STATUS FOR DRIVE COMMUNICATIONS
I/03013-16=COMM               :STATUS FOR DRIVE COMMUNICATIONS
I/03013-17=COMM               :STATUS FOR DRIVE COMMUNICATIONS
I/03013-23=COMM               :STATUS FOR DRIVE COMMUNICATIONS
I/03014-01=COMM               :STATUS FOR DRIVE COMMUNICATIONS
I/03014-16=COMM               :STATUS FOR DRIVE COMMUNICATIONS
I/03014-17=COMM               :STATUS FOR DRIVE COMMUNICATIONS
I/03014-23=COMM               :STATUS FOR DRIVE COMMUNICATIONS
I/03015-01=COMM               :STATUS FOR DRIVE COMMUNICATIONS
I/03015-06=COMM               :STATUS FOR DRIVE COMMUNICATIONS
I/03015-17=COMM               :STATUS FOR DRIVE COMMUNICATIONS
I/03015-23=COMM               :STATUS FOR DRIVE COMMUNICATIONS
I/03016-01=COMM               :STATUS FOR DRIVE COMMUNICATIONS
I/03016-16=COMM               :STATUS FOR DRIVE COMMUNICATIONS
I/03016-17=COMM               :STATUS FOR DRIVE COMMUNICATIONS
I/03016-23=COMM               :STATUS FOR DRIVE COMMUNICATIONS
I/03017-01=COMM               :STATUS FOR DRIVE COMMUNICATIONS
I/03017-16=COMM               :STATUS FOR DRIVE COMMUNICATIONS
I/03017-17=COMM               :STATUS FOR DRIVE COMMUNICATIONS
I/03017-23=COMM               :STATUS FOR DRIVE COMMUNICATIONS
I/03018-01=COMM               :STATUS FOR DRIVE COMMUNICATIONS
I/03018-16=COMM               :STATUS FOR DRIVE COMMUNICATIONS
I/03018-17=COMM               :STATUS FOR DRIVE COMMUNICATIONS
I/03018-23=COMM               :STATUS FOR DRIVE COMMUNICATIONS
I/03019-01=COMM               :STATUS FOR DRIVE COMMUNICATIONS
I/03019-16=COMM               :STATUS FOR DRIVE COMMUNICATIONS
I/03019-17=COMM               :STATUS FOR DRIVE COMMUNICATIONS
I/03019-23=COMM               :STATUS FOR DRIVE COMMUNICATIONS
I/03020-01=COMM               :STATUS FOR DRIVE COMMUNICATIONS
```

| | |
|---|---|
| I/03020-16=COMM | :STATUS FOR DRIVE COMMUNICATIONS |
| I/03020-17=COMM | :STATUS FOR DRIVE COMMUNICATIONS |
| I/03020-23=COMM | :STATUS FOR DRIVE COMMUNICATIONS |
| I/03021-01=COMM | :STATUS FOR DRIVE COMMUNICATIONS |
| I/03021-02=COMM | :STATUS FOR DRIVE COMMUNICATIONS |
| I/03021-03=COMM | :STATUS FOR DRIVE COMMUNICATIONS |
| I/03021-04=COMM | :STATUS FOR DRIVE COMMUNICATIONS |
| I/03021-05=COMM | :STATUS FOR DRIVE COMMUNICATIONS |
| I/03021-06=COMM | :STATUS FOR DRIVE COMMUNICATIONS |
| I/03021-07=COMM | :STATUS FOR DRIVE COMMUNICATIONS |
| I/03021-08=COMM | :STATUS FOR DRIVE COMMUNICATIONS |
| I/03021-09=COMM | :STATUS FOR DRIVE COMMUNICATIONS |
| I/03021-10=COMM | :STATUS FOR DRIVE COMMUNICATIONS |
| I/03021-16=COMM | :STATUS FOR DRIVE COMMUNICATIONS |
| I/03021-17=COMM | :STATUS FOR DRIVE COMMUNICATIONS |
| I/03021-23=COMM | :STATUS FOR DRIVE COMMUNICATIONS |
| I/03022-01=COMM | :STATUS FOR DRIVE COMMUNICATIONS |
| I/03022-02=COMM | :STATUS FOR DRIVE COMMUNICATIONS |
| I/03022-03=COMM | :STATUS FOR DRIVE COMMUNICATIONS |
| I/03022-04=COMM | :STATUS FOR DRIVE COMMUNICATIONS |
| I/03022-05=COMM | :STATUS FOR DRIVE COMMUNICATIONS |
| I/03023-01=COMM | :STATUS FOR DRIVE COMMUNICATIONS |
| I/03023-02=COMM | :STATUS FOR DRIVE COMMUNICATIONS |
| I/03023-03=COMM | :STATUS FOR DRIVE COMMUNICATIONS |
| I/03023-04=COMM | :STATUS FOR DRIVE COMMUNICATIONS |
| I/03023-05=COMM | :STATUS FOR DRIVE COMMUNICATIONS |
| I/03023-06=COMM | :STATUS FOR DRIVE COMMUNICATIONS |
| I/03023-08=COMM | :STATUS FOR DRIVE COMMUNICATIONS |
| I/03023-09=COMM | :STATUS FOR DRIVE COMMUNICATIONS |
| I/03023-10=COMM | :STATUS FOR DRIVE COMMUNICATIONS |
| I/03023-11=COMM | :STATUS FOR DRIVE COMMUNICATIONS |
| I/03023-12=COMM | :STATUS FOR DRIVE COMMUNICATIONS |
| I/03023-13=COMM | :STATUS FOR DRIVE COMMUNICATIONS |
| I/03023-14=COMM | :STATUS FOR DRIVE COMMUNICATIONS |
| I/03023-15=COMM | :STATUS FOR DRIVE COMMUNICATIONS |
| I/03023-16=COMM | :STATUS FOR DRIVE COMMUNICATIONS |
| I/03024-01=COMM | :STATUS FOR DRIVE COMMUNICATIONS |
| I/03024-02=COMM | :STATUS FOR DRIVE COMMUNICATIONS |
| I/03024-03=COMM | :STATUS FOR DRIVE COMMUNICATIONS |
| I/03024-04=COMM | :STATUS FOR DRIVE COMMUNICATIONS |
| I/03024-05=COMM | :STATUS FOR DRIVE COMMUNICATIONS |
| I/03027-02=COMM | :STATUS FOR DRIVE COMMUNICATIONS |
| I/03027-03=COMM | :STATUS FOR DRIVE COMMUNICATIONS |
| I/03027-05=COMM | :STATUS FOR DRIVE COMMUNICATIONS |
| I/03027-07=COMM | :STATUS FOR DRIVE COMMUNICATIONS |
| I/03027-08=COMM | :STATUS FOR DRIVE COMMUNICATIONS |
| I/03028-02=COMM | :STATUS FOR DRIVE COMMUNICATIONS |
| I/03028-03=COMM | :STATUS FOR DRIVE COMMUNICATIONS |
| I/03028-04=COMM | :STATUS FOR DRIVE COMMUNICATIONS |
| I/03028-05=COMM | :STATUS FOR DRIVE COMMUNICATIONS |
| I/03028-06=COMM | :STATUS FOR DRIVE COMMUNICATIONS |
| I/03028-07=COMM | :STATUS FOR DRIVE COMMUNICATIONS |
| I/03034-01=COMM | :STATUS FOR DRIVE COMMUNICATIONS |
| I/03050-01=COMM | :STATUS FOR DRIVE COMMUNICATIONS |
| I/03050-16=COMM | :STATUS FOR DRIVE COMMUNICATIONS |
| I/03050-23=COMM | :STATUS FOR DRIVE COMMUNICATIONS |
| I/03052-01=COMM | :STATUS FOR DRIVE COMMUNICATIONS |
| I/03125-01=COMM | :STATUS FOR DRIVE COMMUNICATIONS |

What is claimed is:

1. A centrifugal device comprising:

receiving means for receiving a load to be centrifuged;

a drive motor operatively connected to said receiving means for rotating said receiving means; and controller means for supplying operative power to said drive motor to rotate said receiving means, said controller means including braking means for varying said operative power to said drive motor based on a rotational speed of said drive motor, thereby causing said drive motor to decelerate, said braking means comprising:

means for applying a first voltage ramp to said drive motor when said rotational speed of said drive motor is above a first level; and means for applying a second voltage ramp to said drive motor when said rotational speed of said drive motor is between said first level and a second level.

2. The centrifugal device according to claim 1, wherein said braking means further comprises:

means for applying a third voltage ramp to said drive motor when said rotational speed of said drive motor is below said second level.

3. The centrifugal device according to claim 1, wherein said first level is above said second level.

4. The centrifugal device according to claim 3, wherein said first level is 900 revolutions per minute and said second level is 500 revolutions per minute.

5. The centrifugal device according to claim 2, wherein said first voltage ramp is steeper than said second voltage ramp and said third voltage ramp.

6. The centrifugal device according to claim 5, wherein said third voltage ramp is steeper than said second voltage ramp.

7. The centrifugal device according to claim 1, wherein said controller means includes a programmable logic controller.

8. The centrifugal device according to claim 7, further comprising a ladder logic program stored in a memory of said programmable logic controller.

9. A centrifugal device comprising:

receiving means for receiving a load to be centrifuged;

a drive motor operatively connected to said receiving means for rotating said receiving means; and controller means for supplying operative power to said drive motor to rotate said receiving means and for selectively applying said operative power to said drive motor to dynamically brake said drive motor, said controller means including braking means comprising:

means for applying a first voltage ramp to said drive motor when said rotational speed of said drive motor is above a first level; and means for applying a second voltage ramp to said drive motor when said rotational speed of said drive motor is between said first level and a second level.

10. The centrifugal device according to claim 9, said controller means further comprising:

means for generating a speed signal representative of a rotational speed of said drive motor; and means for determining said first voltage ramp and said second voltage ramp based on said speed signal and data representative of a dynamic braking curve of said drive motor.

11. The centrifugal device according to claim 10, wherein:

said data describes a three-segment braking curve.

12. A method of braking a centrifugal drive motor comprising the steps of:

sensing a rotational speed of said centrifugal drive motor;

applying a first braking signal to said centrifugal drive motor calculated to reduce said rotational speed of said centrifugal drive motor to zero within a first time period; and after said first braking signal is applied to said centrifugal drive motor and substantially before said rotational speed of said centrifugal drive motor reaches zero, applying a second braking signal to said centrifugal drive motor calculated to reduce further said rotational speed of said centrifugal drive motor to zero within a second time period less than said first time period.

13. The method of braking a centrifugal drive motor according to claim 12, comprising a further step of, after said step of applying said second braking signal, applying a third braking signal to said centrifugal drive motor calculated to reduce further said rotational speed of said centrifugal drive motor to zero within a third time period less than said second time period.

14. A centrifugal device comprising:

receiving means for receiving a load to be centrifuged;

a drive motor operatively connected to said receiving means for rotating said receiving means; and controller means for supplying operative power to said drive motor to rotate said receiving means in an acceleration cycle, a spin cycle, a braking cycle and a plow-out cycle, said controller means including plow-out means for varying said operative power to said drive motor in said plow-out cycle so as to operate said drive motor at a first speed and at a second speed less than said first speed during said plow-out cycle.

15. The centrifugal device according to claim 14, said plow-out means comprising:

first driving means for driving said drive motor to said first speed; and second driving means for, after said drive motor is driven to said first speed, decelerating said drive motor to said second speed.

16. The centrifugal device according to claim 15, further comprising:

means for receiving a speed signal representative of a rotational speed of said drive motor;

wherein said first driving means and said second driving means are each responsive to said speed signal.

17. The centrifugal device according to claim 15, wherein said first speed is 85 rpm and said second speed is 50 rpm.

18. A method of plowing out a basket of a centrifugal device, said method comprising the steps of:

firstly driving a drive motor of said centrifugal device at a first speed during a plow-out cycle to provide a sufficient amount of torque to plow-out said basket of said centrifugal device; and after said step of firstly driving, secondly driving said drive motor at a second speed different from said first speed while plowing out said basket of said centrifugal device.

* * * * *